US007922635B2

(12) United States Patent
Lull et al.

(10) Patent No.: US 7,922,635 B2
(45) Date of Patent: Apr. 12, 2011

(54) ADJUSTABLE-LOAD UNITARY MULTI-POSITION BENCH EXERCISE UNIT

(75) Inventors: Andrew P. Lull, Boulder, CO (US); Zachary D. Krapfl, Rollinsville, CO (US); William A. Baker, Longmont, CO (US); Patrick A. Warner, Boulder, CO (US); Michael H. Harding, Boulder, CO (US); Richard W. Trevino, Tyler, TX (US)

(73) Assignee: Nautilus, Inc., Vancouver, WA (US)

( * ) Notice: Subject to any disclaimer, the term of this patent is extended or adjusted under 35 U.S.C. 154(b) by 113 days.

(21) Appl. No.: 09/802,835

(22) Filed: Mar. 8, 2001

(65) Prior Publication Data

US 2002/0077230 A1 Jun. 20, 2002

Related U.S. Application Data

(60) Provisional application No. 60/188,381, filed on Mar. 10, 2000.

(51) Int. Cl.
*A63B 26/00* (2006.01)

(52) U.S. Cl. ..... 482/142

(58) Field of Classification Search ..... 452/142, 452/148, 95–100, 131, 907, 908, 121–129; 601/24–35; 606/241–245
See application file for complete search history.

(56) References Cited

U.S. PATENT DOCUMENTS

| | | | |
|---|---|---|---|
| 37,713 | A | 2/1863 | Van Houten |
| 43,149 | A | 6/1864 | Wood |
| 108,401 | A | 10/1870 | Smith |
| 192,338 | A | 6/1877 | Marshall |
| 393,265 | A | 11/1888 | Rice |
| 457,400 | A | 8/1891 | Dowd |
| 511,251 | A | 12/1893 | Pickles |
| 551,803 | A | 12/1895 | Whitely |
| 595,492 | A | 12/1897 | McFadden |
| 629,655 | A | 7/1899 | Bryon, Jr. |
| 664,210 | A | 12/1900 | Bryon, Jr. |
| 684,688 | A | 10/1901 | Herz |
| 685,788 | A | 11/1901 | McFadden |
| 691,538 | A | 1/1902 | Frigerio |
| 716,520 | A | 12/1902 | Cole |

(Continued)

FOREIGN PATENT DOCUMENTS

FR 2 545 724 A1 11/1984

(Continued)

OTHER PUBLICATIONS

Cybex World, "New Products Prove Passion for Human Performance", vol. 10, Issue 2, Jul. 2000.

(Continued)

*Primary Examiner* — Lori Baker
(74) *Attorney, Agent, or Firm* — Dorsey & Whitney LLP

(57) ABSTRACT

An exercise unit that is a bench-based, has an easily adjustable load exercise system using a resistance engine that can provide a constant load level through the entire range of motion to approximate the use of free-weights, is portable, and reconfigures easily to several different shapes for different exercises. The exercise unit is compact, has a minimal vertical height, and weighs much less than the maximum resistance load that it can create. The bench unit can be stood on its end for compact storage.

55 Claims, 16 Drawing Sheets

U.S. PATENT DOCUMENTS

| | | | | |
|---|---|---|---|---|
| 763,475 | A | | 6/1904 | Frazee et al. |
| 772,906 | A | | 10/1904 | Reach |
| 776,824 | A | | 12/1904 | Bryon, Jr. |
| 799,270 | A | | 9/1905 | Roland |
| 848,272 | A | | 3/1907 | Thornley |
| 885,074 | A | | 4/1908 | Nidever |
| 1,053,109 | A | | 2/1913 | Reach |
| 1,205,426 | A | | 11/1916 | Bamhill |
| 1,371,750 | A | | 3/1921 | Fox |
| 1,547,268 | A | | 7/1925 | Sotomayor |
| 1,585,748 | A | | 5/1926 | Wendelken |
| 1,646,818 | A | | 10/1927 | Holland |
| 1,703,104 | A | | 2/1929 | Hassler |
| 1,745,435 | A | | 2/1930 | Mensendieck |
| 1,867,642 | A | | 7/1932 | Woods |
| 1,928,089 | A | | 9/1933 | Blickman |
| 2,131,570 | A | | 9/1938 | Riley |
| 2,223,309 | A | | 11/1940 | Swanson |
| 2,436,987 | A | | 3/1948 | Bailleaux |
| 2,632,645 | A | | 3/1953 | Barkschat |
| 2,753,722 | A | | 7/1956 | De Grave |
| 2,788,211 | A | | 4/1957 | Ivanoff |
| 2,855,199 | A | | 10/1958 | Noland et al. |
| 2,921,791 | A | | 1/1960 | Beme |
| 2,944,592 | A | | 7/1960 | Halter |
| 2,977,120 | A | | 3/1961 | Morris |
| 3,306,611 | A | | 2/1967 | Gaul |
| 3,309,084 | A | | 3/1967 | Simmons |
| 3,323,366 | A | | 6/1967 | DeLorme, Jr. et al. |
| 3,342,485 | A | | 9/1967 | Gaul |
| 3,379,439 | A | | 4/1968 | Sorenson et al. ..... 272/64 |
| 3,550,523 | A | | 12/1970 | Segal |
| 3,567,219 | A | | 3/1971 | Foster |
| 3,575,058 | A | | 4/1971 | Kraus |
| 3,588,101 | A | | 6/1971 | Jungreis |
| 3,596,907 | A | | 8/1971 | Brighton et al. |
| 3,598,404 | A | | 8/1971 | Bowman |
| 3,614,097 | A | | 10/1971 | Blickman |
| 3,638,941 | A | | 2/1972 | Kulkens |
| 3,647,209 | A | | 3/1972 | La Lanne |
| 3,658,327 | A | | 4/1972 | Thiede |
| 3,662,602 | A | | 5/1972 | Weiss |
| 3,701,529 | A | | 10/1972 | Kruthaupt |
| 3,707,285 | A | | 12/1972 | Martin |
| 3,708,167 | A | | 1/1973 | Potgieter |
| 3,712,613 | A | | 1/1973 | Feather et al. |
| 3,734,495 | A | | 5/1973 | Nist et al. |
| 3,752,473 | A | | 8/1973 | La Lanne |
| 3,759,512 | A | | 9/1973 | Yount et al. |
| 3,822,599 | A | | 7/1974 | Brentham |
| 3,850,431 | A | | 11/1974 | Winans |
| 3,856,297 | A | | 12/1974 | Schnell |
| 3,858,873 | A | | 1/1975 | Jones |
| 3,912,261 | A | | 10/1975 | Lambert, Sr. |
| 3,970,302 | A | | 7/1976 | McFee |
| 3,981,500 | A | | 9/1976 | Ryan |
| 3,998,454 | A | | 12/1976 | Jones |
| 4,063,727 | A | | 12/1977 | Hall |
| 4,066,259 | A | | 1/1978 | Brentham |
| 4,082,267 | A | | 4/1978 | Flavell |
| 4,109,907 | A | | 8/1978 | Zito |
| 4,111,414 | A | | 9/1978 | Roberts |
| 4,114,610 | A | | 9/1978 | Koch |
| 4,129,297 | A | | 12/1978 | Dolan |
| 4,130,014 | A | | 12/1978 | Eddens |
| 4,149,713 | A | | 4/1979 | McLeod |
| 4,154,441 | A | | 5/1979 | Gajda |
| 4,200,279 | A | | 4/1980 | Lambert, Jr. |
| 4,204,676 | A | | 5/1980 | Givens |
| 4,208,049 | A | | 6/1980 | Wilson |
| D256,821 | S | | 9/1980 | Weider |
| 4,229,002 | A | | 10/1980 | Masters |
| 4,231,568 | A | | 11/1980 | Riley et al. |
| 4,235,437 | A | | 11/1980 | Ruis et al. |
| 4,240,626 | A | | 12/1980 | Lambert, Jr. |
| 4,240,627 | A | | 12/1980 | Brentham |
| 4,247,098 | A | | 1/1981 | Brentham |
| 4,254,949 | A | | 3/1981 | Brentham |
| 4,257,592 | A | | 3/1981 | Jones |
| 4,290,597 | A | | 9/1981 | Schleffendorf |
| 4,296,924 | A | | 10/1981 | Anzaldua et al. |
| 4,328,965 | A | | 5/1982 | Hatfield |
| 4,336,934 | A | | 6/1982 | Hanagan et al. |
| 4,349,192 | A | | 9/1982 | Lambert, Jr. et al. |
| 4,349,193 | A | | 9/1982 | Lambert, Jr. et al. |
| 4,354,675 | A | | 10/1982 | Barclay et al. |
| 4,354,676 | A | | 10/1982 | Ariel |
| 4,357,010 | A | | 11/1982 | Telle |
| 4,357,011 | A | | 11/1982 | Voris |
| RE31,113 | E | | 12/1982 | Coker et al. |
| 4,363,480 | A | | 12/1982 | Fisher et al. ..... 272/69 |
| RE31,170 | E | | 3/1983 | Mazman |
| 4,387,893 | A | | 6/1983 | Baldwin |
| 4,387,894 | A | | 6/1983 | Baumann |
| 4,397,462 | A | | 8/1983 | Wilmarth |
| 4,398,713 | A | | 8/1983 | Ellis |
| 4,402,505 | A | | 9/1983 | Young |
| 4,405,128 | A | | 9/1983 | McLaughlin et al. |
| 4,407,503 | A | | 10/1983 | Nishizawa |
| 4,411,421 | A | | 10/1983 | Hershberger |
| 4,411,424 | A | | 10/1983 | Barnett |
| 4,426,077 | A | | 1/1984 | Becker |
| 4,428,578 | A | | 1/1984 | Kirkpatrick |
| 4,429,871 | A | | 2/1984 | Flechner |
| 4,456,245 | A | | 6/1984 | Baldwin |
| 4,466,613 | A | | 8/1984 | Reese |
| 4,478,411 | A | | 10/1984 | Baldwin |
| 4,478,413 | A | * | 10/1984 | Siwula ..... 272/134 |
| 4,493,485 | A | | 1/1985 | Jones |
| 4,494,662 | A | | 1/1985 | Clymer |
| 4,500,089 | A | | 2/1985 | Jones |
| 4,502,681 | A | | 3/1985 | Blomqvist |
| 4,505,475 | A | | 3/1985 | Olschansky et al. |
| 4,511,137 | A | * | 4/1985 | Jones ..... 272/118 |
| 4,512,571 | A | | 4/1985 | Hermelin |
| 4,515,363 | A | | 5/1985 | Schleffendorf |
| 4,535,985 | A | | 8/1985 | Mask |
| 4,536,027 | A | | 8/1985 | Brennan |
| 4,540,171 | A | | 9/1985 | Clark et al. |
| 4,542,899 | A | | 9/1985 | Hendricks |
| 4,546,971 | A | | 10/1985 | Raasoch |
| 4,549,733 | A | | 10/1985 | Salyer |
| 4,555,109 | A | | 11/1985 | Hartmann |
| 4,556,216 | A | | 12/1985 | Alan |
| 4,568,078 | A | | 2/1986 | Weiss |
| 4,589,656 | A | | 5/1986 | Baldwin |
| D284,597 | S | | 7/1986 | Smith et al. |
| 4,598,908 | A | | 7/1986 | Morgan |
| 4,600,196 | A | | 7/1986 | Jones |
| 4,601,466 | A | | 7/1986 | Lais |
| 4,602,373 | A | | 7/1986 | Dorfman |
| 4,603,855 | A | | 8/1986 | Sebelle |
| 4,605,389 | A | | 8/1986 | Westhoff |
| 4,606,541 | A | | 8/1986 | Kirkpatrick |
| 4,609,189 | A | * | 9/1986 | Brasher ..... 482/102 |
| 4,609,193 | A | | 9/1986 | Paris et al. |
| 4,620,704 | A | | 11/1986 | Shifferaw |
| 4,621,807 | A | | 11/1986 | Stramer |
| 4,624,457 | A | | 11/1986 | Silberman et al. |
| 4,627,615 | A | | 12/1986 | Nurkowski |
| 4,629,185 | A | | 12/1986 | Amann |
| 4,632,388 | A | | 12/1986 | Schleffendorf |
| 4,632,390 | A | | 12/1986 | Richey |
| 4,634,118 | A | | 1/1987 | Jensen |
| 4,634,127 | A | | 1/1987 | Rockwell |
| 4,635,926 | A | | 1/1987 | Minkow |
| 4,640,508 | A | | 2/1987 | Escher |
| 4,643,420 | A | | 2/1987 | Riley et al. |
| 4,645,205 | A | | 2/1987 | Wolff |
| 4,648,594 | A | | 3/1987 | Schleffendorf |
| 4,653,750 | A | | 3/1987 | McIntyre |
| 4,666,149 | A | | 5/1987 | Olschansky et al. |
| 4,666,152 | A | | 5/1987 | Jones |
| 4,684,124 | A | | 8/1987 | Escher |
| 4,684,125 | A | | 8/1987 | Lantz |
| 4,685,670 | A | | 8/1987 | Zinkin |
| 4,690,402 | A | | 9/1987 | Basting |

4,697,809 A 10/1987 Rockwell
4,700,944 A 10/1987 Sterba et al.
4,703,928 A 11/1987 Escher
4,709,918 A 12/1987 Grinblat
4,709,920 A 12/1987 Schnell
4,721,303 A 1/1988 Fitzpatrick
4,722,522 A 2/1988 Lundgren
4,725,056 A 2/1988 Behrl et al.
4,725,057 A 2/1988 Shifferaw
4,730,828 A 3/1988 Lane
4,730,829 A 3/1988 Carlson
4,732,381 A 3/1988 Skowronski
4,733,860 A 3/1988 Steffee
4,743,011 A 5/1988 Coffey
4,749,182 A 6/1988 Duggan
4,749,189 A 6/1988 Frank
4,750,736 A 6/1988 Watterson
4,753,126 A 6/1988 Sammaratano
4,756,527 A 7/1988 Ledbetter
4,763,897 A 8/1988 Yakata
4,765,613 A 8/1988 Voris ..... 272/129
4,765,614 A 8/1988 Shute
4,768,779 A 9/1988 Oehman, Jr. et al.
4,772,015 A 9/1988 Carlson et al.
4,773,398 A 9/1988 Tatom
4,781,374 A 11/1988 Lederman
4,793,608 A 12/1988 Mahnke et al.
D299,371 S 1/1989 Tsuyama
4,795,149 A 1/1989 Pearson
4,796,881 A 1/1989 Watterson
4,804,179 A 2/1989 Murphy
4,809,972 A 3/1989 Rasmussen et al.
4,809,973 A 3/1989 Johns
4,813,667 A 3/1989 Watterson
4,815,746 A 3/1989 Ward, Jr.
4,822,032 A 4/1989 Whitmore et al.
4,822,036 A 4/1989 Dang
4,824,104 A 4/1989 Bloch
4,826,153 A 5/1989 Schalip
4,826,157 A 5/1989 Fitzpatrick
4,834,365 A 5/1989 Jones
4,834,367 A 5/1989 Salyer et al.
4,836,536 A 6/1989 Jones
4,836,537 A 6/1989 Moreno
4,838,548 A 6/1989 Maag
4,840,373 A 6/1989 Maag
4,842,268 A 6/1989 Jenkins
4,842,271 A 6/1989 Vinciguerra
4,842,272 A 6/1989 Jennings
4,844,456 A 7/1989 Habing et al.
4,846,458 A 7/1989 Potts
4,848,741 A 7/1989 Hermanson
4,858,915 A 8/1989 Szabo
4,858,917 A 8/1989 Montgomery
4,861,025 A 8/1989 Rockwell
4,863,161 A 9/1989 Telle ..... 272/117
4,863,163 A 9/1989 Wehrell
4,869,497 A 9/1989 Stewart et al.
4,872,668 A 10/1989 McGillis et al.
4,872,670 A 10/1989 Nichols
4,878,397 A 11/1989 Lennon
4,878,662 A 11/1989 Chern
4,878,663 A 11/1989 Luquette
4,883,270 A 11/1989 Maag
4,889,336 A 12/1989 Schneiderman
4,890,830 A 1/1990 Kern
D306,050 S 2/1990 Brentham
4,898,381 A 2/1990 Gordon
4,900,018 A 2/1990 Ish, III et al.
4,902,007 A 2/1990 Ferrari
4,902,009 A 2/1990 Jones
4,907,798 A 3/1990 Burchatz
4,911,435 A 3/1990 Johns
4,911,438 A 3/1990 Van Straaten
4,913,423 A 4/1990 Farran et al.
D307,782 S 5/1990 Birrell et al.
4,921,242 A 5/1990 Watterson
4,930,768 A 6/1990 Lapcevic
4,944,511 A * 7/1990 Francis ..... 272/137
4,949,951 A 8/1990 Deola
4,961,428 A 10/1990 Nikias et al.
4,974,838 A 12/1990 Sollenberger
4,979,737 A 12/1990 Kock
4,982,955 A 1/1991 Heasley
4,986,538 A 1/1991 Ish, III
4,988,095 A 1/1991 Ferrari
4,993,666 A 2/1991 Baymak et al.
5,000,446 A 3/1991 Sarno
5,002,271 A 3/1991 Gonzales
5,011,139 A 4/1991 Towley
D317,032 S 5/1991 Eckler
5,018,725 A 5/1991 Cook
5,020,794 A 6/1991 Englehardt et al. ..... 272/129
D317,959 S 7/1991 Francis
5,029,850 A 7/1991 van Straaten
5,037,089 A 8/1991 Spagnuolo et al. ..... 272/134
5,039,089 A 8/1991 Lapcevic
5,039,091 A 8/1991 Johnson
5,039,092 A * 8/1991 Olschansky et al. ..... 482/130
5,042,798 A 8/1991 Sawicky
5,042,799 A 8/1991 Stanley
5,042,801 A 8/1991 Sterba et al.
5,044,629 A 9/1991 Ryan et al.
5,044,631 A 9/1991 Jones
5,044,632 A 9/1991 Jones
5,050,873 A 9/1991 Jones
D321,025 S 10/1991 Jones
D321,026 S 10/1991 Jones
D321,027 S 10/1991 Jones
D321,028 S 10/1991 Jones
5,056,779 A 10/1991 Webb
5,060,938 A 10/1991 Hawley, Jr.
5,060,939 A 10/1991 Oswald et al.
D321,387 S 11/1991 Jones
D321,389 S 11/1991 Jones
D321,390 S 11/1991 Jones
D321,391 S 11/1991 Jones
5,062,632 A 11/1991 Dalebout et al. ..... 272/129
5,062,633 A 11/1991 Engel et al.
5,064,191 A 11/1991 Johnson
5,066,003 A 11/1991 Jones
5,066,004 A 11/1991 Jones
5,069,447 A 12/1991 Snyderman et al.
5,074,551 A * 12/1991 Olschansky et al. ..... 482/137
5,076,576 A 12/1991 Johnston
5,076,577 A 12/1991 Houston
5,076,578 A 12/1991 Askonen
5,076,579 A 12/1991 Rickey
5,080,349 A 1/1992 Vittone
5,080,351 A 1/1992 Rockwell
5,085,430 A 2/1992 Habing
5,089,960 A 2/1992 Sweeney, Jr. ..... 364/410
5,090,694 A 2/1992 Pauls et al.
D324,710 S 3/1992 Habing
5,094,124 A 3/1992 Stonehouse
5,094,449 A 3/1992 Stearns
5,094,450 A 3/1992 Stearns
5,100,131 A 3/1992 Fong
5,102,121 A 4/1992 Solow et al.
5,102,122 A 4/1992 Piane, Jr. et al.
5,104,121 A 4/1992 Webb
5,106,080 A 4/1992 Jones
5,106,081 A 4/1992 Webb
5,106,083 A 4/1992 Hall
5,108,095 A 4/1992 Nichols
5,116,297 A 5/1992 Stonecipher
5,120,289 A 6/1992 Yu
5,122,106 A 6/1992 Atwood et al.
5,123,886 A 6/1992 Cook
5,125,881 A 6/1992 Jones
5,125,882 A 6/1992 La Mothe et al.
D328,320 S 7/1992 Hliang
5,135,216 A 8/1992 Bingham et al.
5,135,449 A 8/1992 Jones
5,135,453 A 8/1992 Sollenberger
5,135,456 A 8/1992 Jones
5,135,458 A 8/1992 Huang
5,135,459 A 8/1992 Perry, Jr.

5,145,479 A * 9/1992 Olschansky et al. ..... 482/62
5,147,265 A 9/1992 Pauls et al.
5,171,198 A 12/1992 Jones
5,180,354 A 1/1993 Jones
5,181,896 A 1/1993 Jones
D334,042 S 3/1993 Wang
5,190,513 A 3/1993 Habing et al.
5,195,937 A 3/1993 Engel et al.
5,199,935 A 4/1993 Gibson et al.
5,201,694 A 4/1993 Zappel
5,203,755 A 4/1993 Kaiser
5,205,802 A 4/1993 Swisher
5,205,804 A 4/1993 Hall
D335,511 S 5/1993 Engel et al.
5,209,461 A 5/1993 Whightsil, Sr. ..... 267/155
5,211,614 A 5/1993 Henes
D336,498 S 6/1993 Engel et al.
5,217,487 A 6/1993 Engel et al.
5,221,244 A 6/1993 Doss
5,221,245 A 6/1993 Yeh
D337,361 S 7/1993 Engel et al.
D337,666 S 7/1993 Peterson et al.
5,226,867 A 7/1993 Beal
5,230,680 A 7/1993 Wu
5,236,406 A 8/1993 Webber ..... 482/100
5,242,344 A 9/1993 Hundley
5,242,347 A * 9/1993 Keeton ..... 482/102
5,244,444 A 9/1993 Wostry
5,244,446 A 9/1993 Engel et al.
5,256,126 A 10/1993 Grotstein
D341,176 S 11/1993 Habing et al.
5,263,914 A 11/1993 Simonson et al.
5,263,915 A 11/1993 Habing
5,265,589 A * 11/1993 Wang ..... 601/35
5,267,930 A 12/1993 Henes
5,269,512 A 12/1993 Crowson et al.
5,273,504 A 12/1993 Jones
5,273,505 A 12/1993 Jones
5,273,509 A 12/1993 Vittone
5,277,681 A * 1/1994 Holt ..... 482/112
5,282,776 A 2/1994 Dalebout
RE34,572 E 3/1994 Johnson et al.
5,290,214 A 3/1994 Chen
5,295,931 A 3/1994 Dreibelbis et al.
RE34,577 E 4/1994 Habing et al.
5,299,992 A 4/1994 Wilkinson ..... 482/52
5,300,003 A 4/1994 Hull
5,302,161 A 4/1994 Loubert et al.
5,304,107 A 4/1994 Jones
5,306,221 A 4/1994 Itaru
D347,251 S 5/1994 Dreibelbis et al.
5,308,303 A 5/1994 Rawls et al.
5,308,304 A 5/1994 Habing
5,310,392 A 5/1994 Lo
5,312,313 A 5/1994 Holmes et al.
5,312,315 A 5/1994 Mortensen et al.
5,316,528 A 5/1994 Ziparo
5,316,534 A 5/1994 Dalebout et al.
5,320,591 A 6/1994 Harmon et al.
5,320,592 A 6/1994 Olschansky et al.
5,322,489 A 6/1994 Webb et al.
5,324,246 A 6/1994 Wang
5,328,428 A 7/1994 Huang
5,330,405 A * 7/1994 Habing et al. ..... 482/96
5,330,408 A 7/1994 Westmoreland, Jr.
5,334,113 A 8/1994 Roepke
5,336,140 A 8/1994 LeBlond
5,336,148 A 8/1994 Ish, III
5,342,270 A 8/1994 Jones
5,344,374 A 9/1994 Telle
5,346,447 A 9/1994 Stearns
5,348,524 A 9/1994 Grant
5,354,248 A 10/1994 Rawls et al.
5,354,252 A 10/1994 Habing
5,356,360 A 10/1994 Johns
5,362,290 A 11/1994 Huang
5,366,426 A 11/1994 Glavin ..... 482/56
5,366,432 A 11/1994 Habing et al.
5,374,229 A 12/1994 Sencil
5,378,216 A 1/1995 Ish, III et al.
5,380,258 A 1/1995 Hawley, Jr.
5,382,212 A 1/1995 Davenport et al.
5,387,170 A 2/1995 Rawls et al.
5,395,295 A 3/1995 Ish, III
5,399,133 A 3/1995 Haber et al.
5,403,257 A 4/1995 Lehtonen
5,409,435 A 4/1995 Daniels
D358,183 S 5/1995 Habing et al.
D358,625 S 5/1995 Enriquez, Jr.
5,413,546 A 5/1995 Basile
5,417,633 A 5/1995 Habing
5,417,634 A 5/1995 Habing
D359,326 S 6/1995 Deola
5,421,796 A 6/1995 Jones et al.
5,429,569 A 7/1995 Gunnari et al.
5,431,617 A 7/1995 Rattray, Jr.
5,433,680 A 7/1995 Knudsen
5,435,798 A 7/1995 Habing et al.
5,435,799 A 7/1995 Lundin ..... 482/8
5,437,589 A 8/1995 Habing
5,441,470 A 8/1995 Chen
5,456,644 A 10/1995 Hecox et al.
5,466,204 A 11/1995 Nearing
5,468,202 A 11/1995 Habing
5,468,205 A 11/1995 McFall et al.
5,470,299 A 11/1995 Yeh
5,484,365 A 1/1996 Jones et al.
5,486,150 A 1/1996 Randolph
5,487,714 A 1/1996 Ferrari
5,492,386 A 2/1996 Callum
5,499,959 A 3/1996 Holmes et al.
D368,501 S 4/1996 Woodruff
5,505,681 A 4/1996 Bruggemann
5,511,740 A 4/1996 Loubert et al.
D370,040 S 5/1996 Habing et al.
5,518,477 A 5/1996 Simonson
5,518,479 A 5/1996 Young et al.
D370,949 S 6/1996 Furner
D371,176 S 6/1996 Furner
5,527,243 A 6/1996 Chen
5,527,245 A 6/1996 Dalebout
5,533,953 A 7/1996 Lui et al.
5,542,895 A 8/1996 Colbo, Jr.
5,549,530 A 8/1996 Fulks
5,549,533 A 8/1996 Olson et al.
5,554,084 A 9/1996 Jones
5,554,085 A 9/1996 Dalebout
5,554,086 A 9/1996 Habing et al.
5,554,089 A 9/1996 Jones
5,554,090 A 9/1996 Jones
5,562,577 A 10/1996 Nichols, Sr. et al.
5,580,337 A 12/1996 Habing et al.
5,580,340 A 12/1996 Yu
5,580,341 A 12/1996 Simonson
5,582,564 A 12/1996 Nichols, Sr. et al.
5,586,962 A 12/1996 Hallmark
5,588,938 A 12/1996 Schneider et al.
5,588,942 A 12/1996 Dillard
5,591,105 A 1/1997 Dalebout et al.
5,597,147 A 1/1997 Masahiko
5,597,257 A 1/1997 Habing
5,599,256 A 2/1997 Hughes, Jr.
5,601,518 A 2/1997 Weintraub
RE35,470 E 3/1997 Jones
5,616,107 A 4/1997 Simonson
5,616,110 A * 4/1997 Nascimento ..... 482/131
5,616,111 A 4/1997 Randolph
5,624,353 A 4/1997 Naidus
5,624,362 A 4/1997 Wilson
5,626,548 A 5/1997 Coyle
5,628,715 A 5/1997 Simonson
D380,024 S 6/1997 Novak et al.
5,637,059 A 6/1997 Dalebout
5,643,151 A 7/1997 Naimo
5,655,997 A 8/1997 Greenberg et al. ..... 482/5
5,665,036 A 9/1997 Hsieh
5,667,464 A 9/1997 Simonson
5,669,861 A 9/1997 Toups 5,669,865 A 9/1997 Gordon
5,674,167 A 10/1997 Piaget et al. ..... 482/130
5,681,079 A 10/1997 Robinson
5,692,997 A * 12/1997 Stearns ..... 482/100
5,709,633 A 1/1998 Sokol
5,713,823 A 2/1998 Walendzak et al.
5,716,308 A 2/1998 Lee
5,718,654 A 2/1998 Kennedy
5,722,921 A 3/1998 Simonson
5,722,922 A 3/1998 Watterson et al.
5,725,459 A 3/1998 Rexach
5,733,229 A 3/1998 Dalebout et al.
5,733,231 A 3/1998 Corn et al.
5,733,233 A 3/1998 Webber
5,738,616 A 4/1998 Robertson
5,755,645 A 5/1998 Miller et al.
5,762,584 A 6/1998 Daniels
5,769,757 A 6/1998 Fulks
5,769,766 A 6/1998 Huang
5,776,040 A 7/1998 Webb et al.
5,779,601 A * 7/1998 Ish, III ..... 482/100
5,788,615 A 8/1998 Jones
5,800,321 A 9/1998 Webber
5,803,882 A 9/1998 Habing et al.
5,807,219 A 9/1998 Webber et al.
5,810,698 A 9/1998 Hullett et al.
5,810,701 A 9/1998 Ellis et al.
5,813,951 A 9/1998 Einsig
5,820,529 A 10/1998 Weintraub
5,827,157 A 10/1998 Lee
5,830,116 A * 11/1998 Gautier ..... 482/100
5,836,858 A 11/1998 Sharff
5,839,997 A 11/1998 Roth et al.
5,860,894 A 1/1999 Dalebout
5,876,313 A 3/1999 Krull
5,885,193 A 3/1999 Habing et al.
5,888,179 A 3/1999 Singhal ..... 482/81
5,897,467 A 4/1999 Habing et al.
5,904,638 A 5/1999 Habing et al.
5,906,566 A 5/1999 Whitcomb
5,921,897 A 7/1999 Stevens
5,921,902 A 7/1999 Carpenter
5,931,767 A 8/1999 Morales
5,938,551 A 8/1999 Warner
5,944,641 A 8/1999 Habing
D413,948 S 9/1999 Dalebout
5,951,448 A 9/1999 Bolland
5,961,427 A 10/1999 Habing et al.
5,961,428 A 10/1999 Webber
5,964,684 A 10/1999 Sokol
5,967,954 A 10/1999 Habing
5,971,895 A 10/1999 Habing
5,989,165 A 11/1999 Giannelli et al.
5,993,356 A 11/1999 Houston et al.
6,004,247 A 12/1999 Webber
6,004,248 A 12/1999 Price
6,022,299 A 2/2000 Stewart
6,027,429 A 2/2000 Daniels
6,056,678 A 5/2000 Giannelli et al.
6,059,701 A 5/2000 George et al.
6,074,328 A 6/2000 Johnson
6,090,020 A 7/2000 Webber
6,099,440 A 8/2000 Schurter et al.
6,117,055 A 9/2000 Boland ..... 482/121
6,120,416 A 9/2000 Walker
6,120,421 A 9/2000 Kuo
D431,615 S 10/2000 Webber et al.
6,126,580 A 10/2000 Francis et al.
6,186,927 B1 2/2001 Krull
6,206,812 B1 3/2001 Nizamuddin
6,217,493 B1 4/2001 Spletzer
6,220,993 B1 4/2001 Sencil
6,224,514 B1 5/2001 Price
6,238,323 B1 5/2001 Simonson
6,251,052 B1 6/2001 Simonson
6,257,997 B1 7/2001 Doble et al.
6,258,016 B1 7/2001 Kuo
6,261,022 B1 7/2001 Dalebout et al.
6,264,586 B1 7/2001 Webber
6,264,588 B1 7/2001 Ellis
6,287,241 B1 9/2001 Ellis
6,287,243 B1 9/2001 Isom et al.
6,296,596 B1 10/2001 Alessandri et al.
6,319,178 B1 11/2001 Webber
D455,803 S 4/2002 Webber
6,364,815 B1 4/2002 Lapcevic
6,371,896 B1 4/2002 Kettler
6,394,937 B1 5/2002 Voris
6,402,666 B2 6/2002 Krull
6,409,631 B1 6/2002 Alessandri
6,422,979 B1 7/2002 Krull
6,440,044 B1 8/2002 Francis et al.
6,443,877 B1 9/2002 Hoecht et al.
6,447,430 B1 9/2002 Webb et al.
6,458,061 B2 10/2002 Simonson
6,471,624 B1 10/2002 Voris
6,482,139 B1 11/2002 Haag
6,488,612 B2 12/2002 Sechrest et al.
6,491,609 B2 12/2002 Webber
6,491,610 B1 12/2002 Henn
6,500,106 B1 12/2002 Fulks
6,517,468 B1 2/2003 Lapcevic
6,551,226 B1 4/2003 Webber et al.
6,561,960 B2 5/2003 Webber
6,575,881 B2 6/2003 Lapcevic
6,579,213 B1 6/2003 Webber et al.
6,585,626 B2 7/2003 McBride
6,592,498 B1 7/2003 Trainor
6,595,905 B2 7/2003 McBride
6,605,022 B2 8/2003 Webber
6,626,805 B1 9/2003 Lightbody
6,652,426 B2 11/2003 Carter et al.
6,652,429 B2 11/2003 Bushnell
6,669,606 B2 12/2003 Krull
6,669,609 B2 12/2003 Gerschefske et al.
6,685,602 B2 2/2004 Colosky, Jr. et al.
6,685,607 B1 2/2004 Olson
6,743,158 B2 6/2004 Giannelli et al.
6,746,378 B2 6/2004 Morris et al.
6,746,385 B1 6/2004 Habing
6,770,017 B1 8/2004 Leipheimer
6,817,968 B2 11/2004 Galbraith et al.
6,830,542 B2 12/2004 Ball et al.
6,910,994 B2 6/2005 Mitchell et al.
6,913,565 B2 7/2005 Mitchell et al.
6,929,589 B1 8/2005 Bruggemann et al.
7,179,209 B2 * 2/2007 Sechrest et al. ..... 482/103
7,229,391 B2 6/2007 Francis
2002/0025890 A1 2/2002 Keiser
2002/0035017 A1 3/2002 Pertegaz-Esteban
2002/0198087 A1 12/2002 Mitchell et al.
2002/0198088 A1 12/2002 Vuurmans et al.
2003/0017918 A1 1/2003 Webb et al.
2003/0022767 A1 1/2003 Webber
2003/0032524 A1 2/2003 Lamar et al.
2003/0032531 A1 2/2003 Simonson
2003/0045406 A1 3/2003 Stone
2003/0092540 A1 5/2003 Gillen
2003/0092541 A1 5/2003 Giannelli
2003/0092543 A1 5/2003 Giannelli
2003/0096681 A1 5/2003 Myers et al.
2003/0100413 A1 5/2003 Huang
2003/0114281 A1 6/2003 Mackert et al.
2003/0176261 A1 9/2003 Simonson et al.
2003/0232707 A1 12/2003 Dalebout et al.
2004/0002409 A1 1/2004 Webb et al.
2004/0009856 A1 1/2004 Hammer
2004/0009857 A1 1/2004 Webb et al.
2004/0023760 A1 2/2004 Cockrill, Jr. et al.
2004/0023762 A1 2/2004 Lull et al.
2004/0063551 A1 4/2004 Lightbody
2004/0082444 A1 4/2004 Golesh
2004/0091307 A1 5/2004 James
2004/0176223 A1 9/2004 Morris et al.
2005/0124470 A1 6/2005 Schopf
2007/0184944 A1 8/2007 Huang

FOREIGN PATENT DOCUMENTS

| | | | | |
|---|---|---|---|---|
| TW | 379572 | Y | * | 1/2000 |
| WO | WO 94/14505 | | * | 7/1994 |
| WO | WO 01/066195 | A3 | | 9/2001 |

OTHER PUBLICATIONS

BFit® University Presents Bally "Total Fitness PowerPump the Official Barbell Workout", Training Manual, 1998.

Keiser® Power Pacer, Instructor Training Manual©, by Keiser Corporation, 1997, 1998.

Body Pump™, "Become Some Body?", Press Release, Les Mills International/The STEP Company, date unknown.

Body Pump™, "Aerobic Market 'Pumped Up' about New Zealand's Body Pump™ Program", Press Release, Les Mills International/The STEP Company, date unknown.

Body Pump Training Brochure, The STEP Company/Les Mills International, date uknown.

New Fitness Trend Guarantees Company's Success, Press Release, The STEP® Company, date unknown.

"Taking a Good Idea One STEP Further", Press Release, The Step Company/Les Mills International, date unknown.

Schwinn Iron Classic Strength Training System by Bowflex® Owner's Manual, 55 pages (1993).

U.S. Appl. No. 12/815,873, filed Jun. 15, 2010, Webb.

U.S. Appl. No. 12/907,855, filed Oct. 19, 2010, Dibble et al.

* cited by examiner

ADJUSTABLE-LOAD UNITARY MULTI-POSITION BENCH EXERCISE UNIT

RELATED APPLICATIONS

This application is a non-provisional application based on U.S. Provisional Patent Application Ser. No. 60/188,381, filed Mar. 10, 2000, entitled Variable Load Multi-Position Bench Exercise Unit and Associated Group Exercise Program, which is hereby incorporated by reference in its entirety.

FIELD OF THE INVENTION

This invention relates to the field of exercise equipment, and more particularly to the field of multi-position, convertible exercise equipment.

BACKGROUND

Existing exercise units for resistance training, such as weight lifting, include those having weight stacks that require physically changing the number of plates selected in order to change the load felt during the particular exercise. These units also have several different "stations" for different exercises, and often weigh at least as much as the maximum weight able to be selected, which is often 150 to 200 pounds. These units take up quite a bit of space and are very difficult to move once positioned in a commercial fitness facility or in one's home.

Other exercise devices that allow resistance training use resilient bands or rods. These devices include benches and vertically-extending structures to facilitate various exercises. While taking up much less space than machines based on weight stacks, the different exercises offered are limited. In addition, the resistance loads are typically not constant due to the spring force nature of their resistance systems.

What is needed in the art is a unitary bench-based exercise unit that allows the convenient modification of the exercise load, convenient exercise position changing, takes up minimal vertical space, and can provide a constant load level to replicate the use of free-weights.

SUMMARY

An exercise unit of the present invention is disclosed herein that overcomes the shortcomings discussed above. The exercise unit is a bench-based, easily adjustable load exercise system using a resistance engine that can provide a constant load level through the entire range of motion. The exercise unit is compact, has a minimal vertical height, provides various exercise positions, and weighs much less than the maximum resistance load that it can create.

In greater detail, the instant invention includes an exercise unit having a frame, a seat positioned on said frame, a resistance engine attached to said frame and utilizing elastomeric springs, and an actuator attached to said resistance engine wherein said resistance engine provides a constant load to a user when said actuator is actuated.

In addition, the above exercise unit can include a resistance engine that is able to be selectively pre-loaded.

In addition, the above exercise unit can include a frame defining a bench, with the resistance engine positioned completely below the seat. The invention can further include a spiral pulley used to provide a constant load when using the resistance engine.

In another aspect of the invention, the bench exercise unit can include a frame, a seat positioned on the frame, a resistance engine including means for providing a constant load, at least one movable arm, and an actuator attached to said resistance engine.

In further detail, the one arm is movable in one dimension, two dimensions, or three dimensions.

An additional feature of the present invention is that the bench exercise unit is easily movable by a person, and minimizes the vertical space that it requires.

The instant invention provides several benefits, including the ability to adjust the load without switching plates or removing or replacing any portion of the exercise device, easy transition from one bench configuration to the next for different exercises, combination upper body and lower body workouts on the same machine, and a close approximation to the feel of using free-weights.

Other aspects, features and details of the present invention can be more completely understood by reference to the following detailed description in conjunction with the drawings, and from the appended claims.

DETAILED SPECIFICATION

Figure 1:
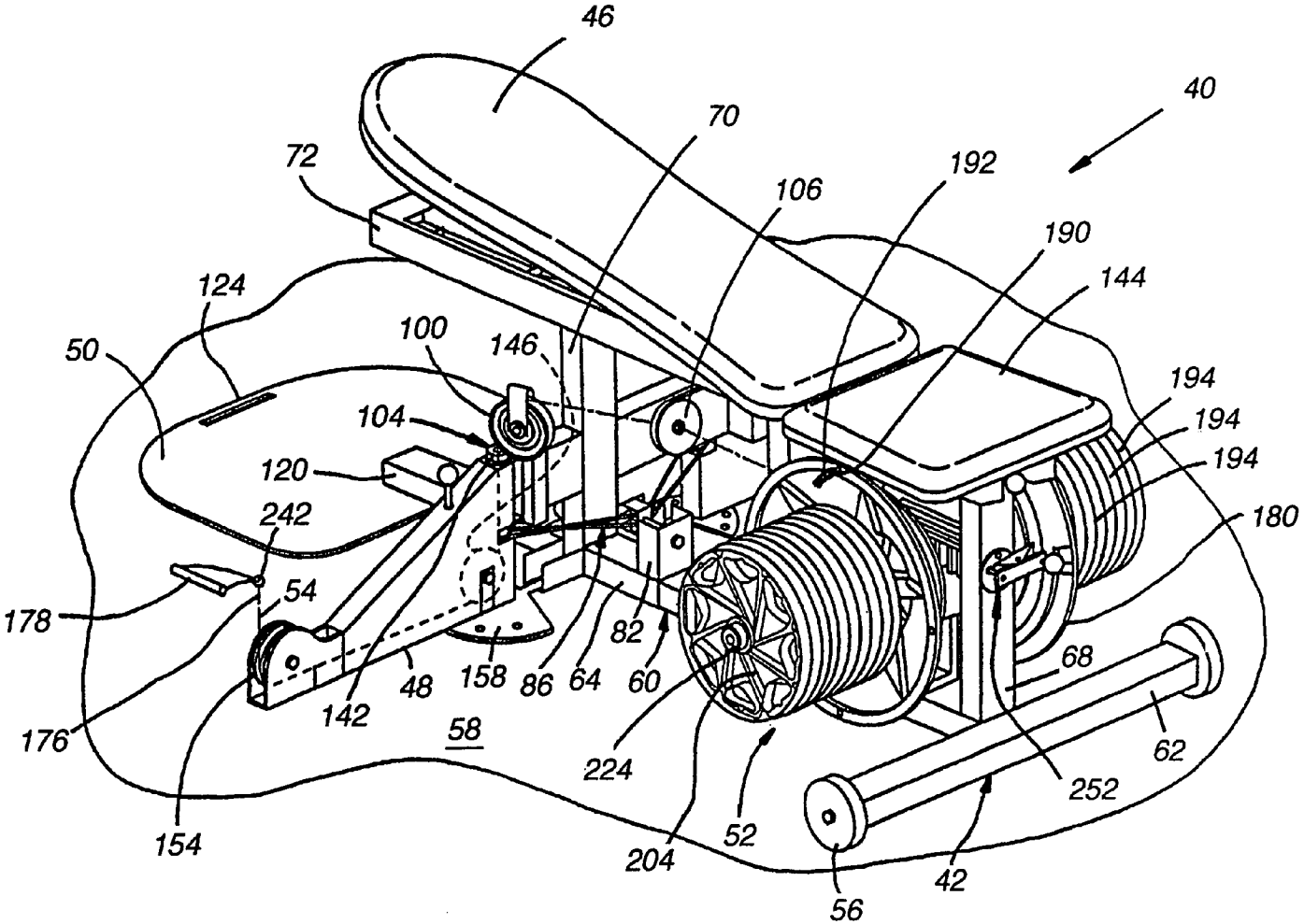
FIG. 1 is a front perspective view of the bench exercising unit of the present invention.

The adjustable-load multi-position bench unit 40 of the present invention is shown in FIG. 1. The bench unit 40 includes a frame structure, an adjustable seat bottom 44 and seat back 46 structure, variable position arm structures 48, a standing support platform 50, and a load or resistance engine 52. The cable 54 used in the system is shown in dash. The bench unit 40 is convertible to several different configurations to allow a user to perform many different exercises on this one piece of equipment. The bench unit 40 is also easily portable to allow it to be moved by the user from one location to another, such as from an active exercise area to a storage area.

The seat bottom 44 and seat back 46 structure, resistance engine, adjustable arm structure 48, and standing support platform 50 are all attached to the frame 42. The bench unit has rollers 56 at one end of the frame structure 42 to allow the bench unit to be rolled by the user to the desired position. The bench unit can also be stood on end, the same end at which the rollers are attached, to allow for efficient vertical storage of the bench. Storing the bench in a vertical orientation minimizes the floor space taken up by the bench when stored.

The seat bottom 44 and seat back 46 structure are attached to the frame 42 in a manner that allows them to be adjusted with respect to the frame. The seat bottom 44 can be adjusted from a horizontal position to an inclined position. The seat back 46 can also be adjusted from a horizontal position to an inclined position. The adjustable arms 48 can be moved to several positions in horizontal arcs along the support surface 58, from parallel to the bench unit 40 and extending toward the standing platform 50 to parallel to the bench unit and extending toward the seat.

The resistance engine 52 is attached to the frame 42 and is positioned generally below the seat bottom 44. The resistance engine extends laterally to both sides of the frame, and does not interfere with the movement of the adjustable arms 48 or the user. The resistance engine is easily adjustable to various desired constant load levels, thereby replicating a free-weight effect, and eliminates the need for adding or removing more traditional weight plates or stack plates. In addition, the resistance engine weighs much less than the load it can create for the user.

The standing support plate 50 rests on the support surface 58 and is adjustable with respect to the frame 42. The user can stand on the support plate for various exercises (typically when the arms 48 are extending parallel to the bench and toward the support plate). This helps anchor the bench 40 to the support surface during these exercises, and provides a stable and consistent area for the user to stand during these exercises.

The instant invention provides a relatively small bench unit 40 that is convertible to allow several different exercises, and includes an easily adjustable resistance engine 52 compactly positioned beneath the bench and out of the user's way.

Figure 2:
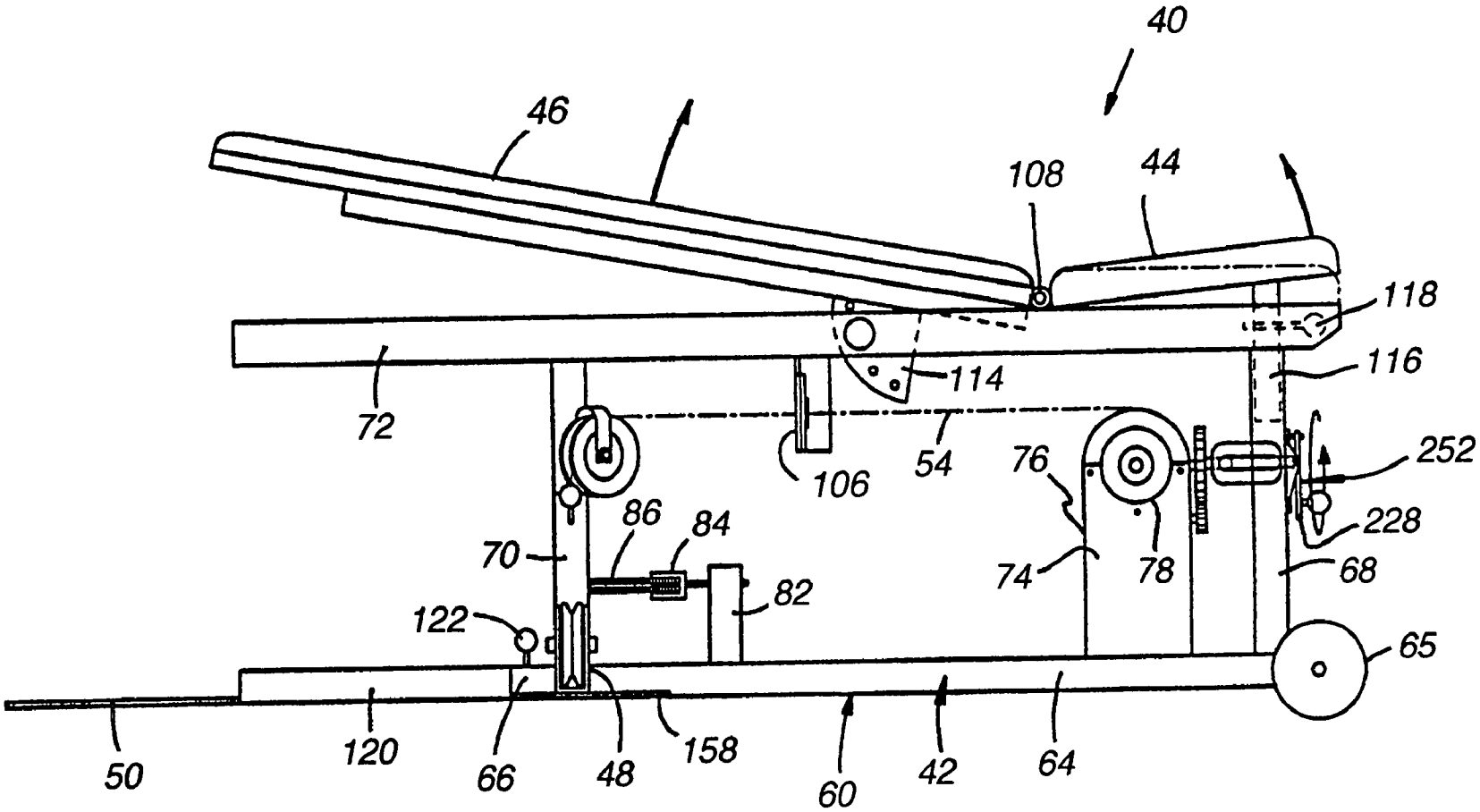
FIG. 2 is an elevation view of the bench exercising unit of the present invention, with the resistance engine removed for clarity, showing the frame, cable/pulley system, the idler, the pre-load mechanism, the pre-load locking mechanism, and the seat back and bottom.
Figure 3:
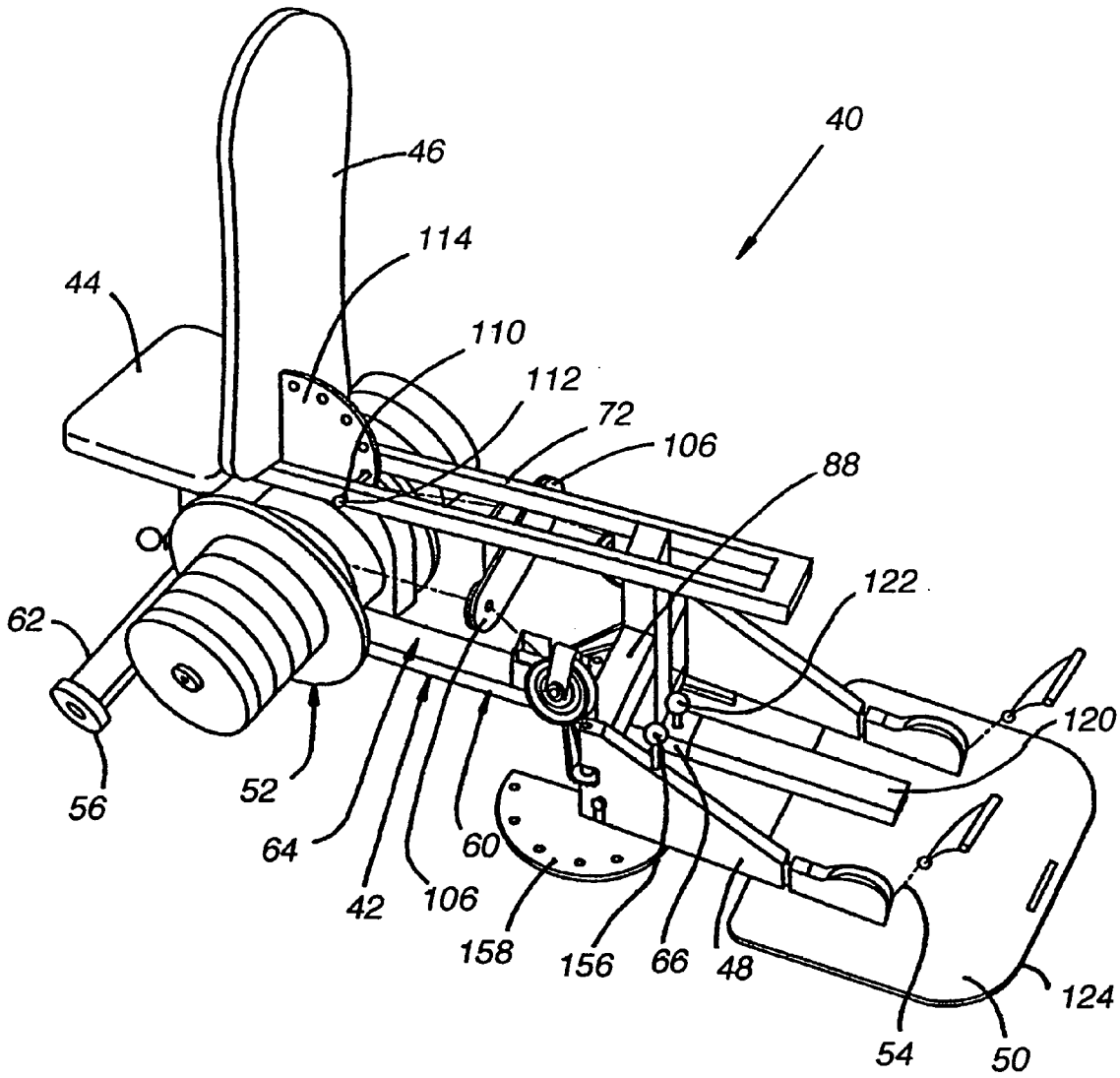
FIG. 3 is a rear perspective view similar to FIG. 2 except the resistance engine is shown, and the seat back is raised.

Referring still to FIG. 1, and to FIGS. 2 and 3, the frame 42 has a base 60 generally shaped like a "T" for engaging the support surface 58. The cross-member 62 of the "T" is the foot end of the bench 40, while the long base member 64 of the "T" extends along the bench, with its free end 66 terminating at the head end of the bench. The long base member 64 of the "T" is made of tubular steel, having a square or circular section, and the cross member 62 is preferably made of tubular steel having a circular or square cross section.

The wheels 56 for allowing easy transport of the bench unit are attached at either end of the cross member 62. Two upright support posts 68 and 70 extend from the long base member 64 of the "T", one adjacent the intersection of the cross member 62 and the second adjacent the free end 66 of the "T". A longitudinally extending top member 72 is attached to the top of the upright support posts. This top member supports the seat bottom 44 and seat back 46, which are both adjustable to various positions on the top member 72 of the frame 42.

Two resistance engine support brackets 74 and 76 (only one is shown, see FIGS. 23 and 13) extend upwardly from the base member 64, one from either side, near the cross member 62 to support the resistance engine 52. The brackets act as a mounting structure for securely holding the resistance engine in place between the upright posts 68 and 70, near the foot end, and below the top member 72. The top of each bracket defines an arcuate cutout 78 therein for receiving a similarly-shaped portion of the preload mechanism portion 80 of the resistance engine.

Another bracket 82 extends upwardly from the base member 64, near the head end upright 70, to hold the idler structure 84 for the chain drive 86.

A lateral support beam 88 (FIGS. 1 and 3) extends from the head end upright member 70, and at each end 90 and 92 defines a support 94 and 96 for a guide pulley 98 and 100 and the pivot structure 102 and 104 for the respective adjustable arm 48.

Both ends 90 and 92, supports 94 and 96, guide pulleys 98 and 100 and pivot structures 102 and 104 are preferably identical; therefore, in the description of the invention reference to only one of such structures may be made.

A pair of fairleads 106, each of which are preferably identical, are suspended from the top member 72 to act as guides for the cable 54. A portion of the frame extends downwardly from the top member, from which a fairlead extends laterally therefrom to either side. As described below, the fairlead can be any suitable cable guide that does not abrade or degrade the cable. One suitable fairlead is a grommet having a beveled inner diameter and being made of hard coat anodized aluminum for long wear and reduced abrasion of the cable.

A pivot bracket 108 (see FIG. 2) extends upwardly from the top member 72 to support the rear end of the seat bottom 44 and the bottom end of the seat back 46 and allows them to pivot at that point to a desired position, as is described below. A collar 110 extends laterally to one side of the top member for receiving a pop-pin 112 for use in the adjustment of the back portion 46, also as is described in greater detail below.

The frame 42 can be made of any material as long as it can withstand the forces and support the functions as described herein.

Referring still to FIGS. 1, 2 and 3, the seat is made up of a seat back portion 46 and a bottom portion 44. The rear end of the bottom portion and the bottom end of the back portion are pivotally attached at a pivot or hinge 108 on the top member 72 of the frame 42. The back portion can be adjusted between a horizontal position and inclined positions. A partial disk 114 having holes along its perimeter extends downwardly from the bottom of the rear side of the back portion (see FIG. 3). The holes align with a pop-pin structure 112 positioned in the collar 110 on the top member to hold the back portion at the desired horizontal or inclined level. The particular positions of the back portion are determined by the position of the holes along the perimeter of the partial disk.

The bottom portion 44 can be adjusted from a horizontal position to an inclined position by pivoting around the hinge 108. A post 116 extends downwardly from the underside of the bottom portion and slidably inserts into the upright at the foot end of the frame 42. A pop-pin structure 118 on the foot end upright 68 selectively engages holes formed in the post to position the bottom portion as desired. Typically, the bottom portion can be positioned in a horizontal orientation and one inclined orientation, however these positions are dependent on the number and location of the positioning holes formed in the post.

Figure 4:
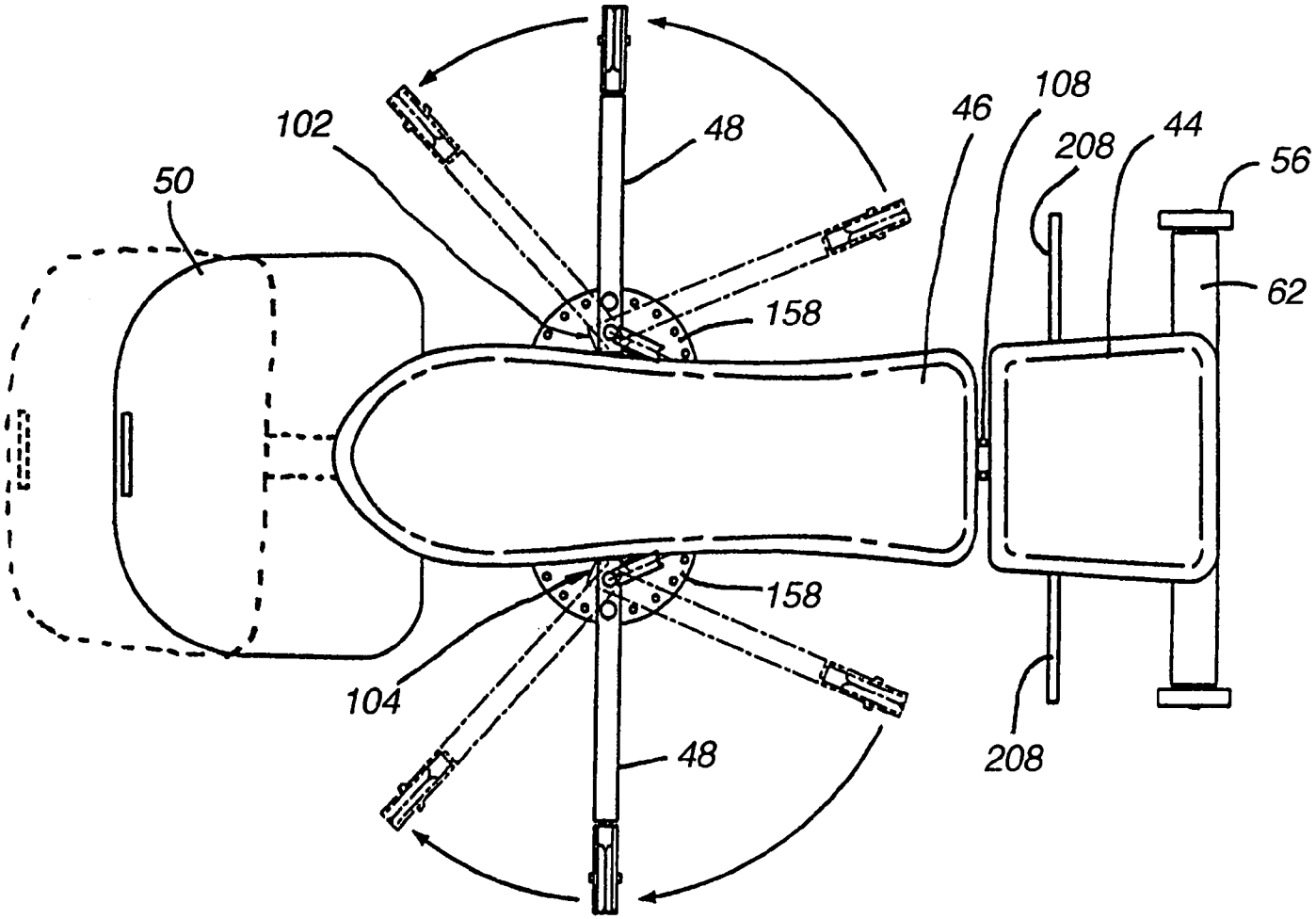
FIG. 4 is a top plan view showing the various ways the arms may be positioned.

Referring to FIGS. 3 and 4, the standing support platform 50 is a flat plate positioned at the back end of the frame base 60 and is movable between an extended and retracted position (see FIGS. 3 and 4). The platform is large enough for a person to stand on for performing exercises and has some type of friction surface on its top side, such as friction tape or metal texturing protrusions. The platform is attached to a post 120 which slides in and out of the frame base member 60 and is fixed in position by a pop-pin 122. The standing support platform thus telescopes in and out of the base member of the frame. The platform has a curved outer edge 124, and defines a hand-grip near the outer edge for use in guiding the bench 40 when suspended on its wheels 56. In the retracted position the bench unit is easier to move and store, and in the extended position the support platform is positioned more properly for performing exercises.

Referring to FIGS. 1-7, each of the arms 48 is attached to an end 90 or 92 of the lateral support beam 88. The attachment structure 102 and associated integral cable guide structure 126 for each arm is preferably identical, so only one side is described herein.

The arm 48 is attached to the lateral beam 88 by a pivot structure 102 which allows the arm to swing with respect to the frame 42 approximately 180° in a horizontal plane, as described generally above. The pivot structure is thus oriented so that the pivot axis extends vertically relative to the bench 40 while sitting on a horizontal support surface 58. The arm is positioned adjacent to the support surface (floor) to form a low pulley for various exercises performed on the bench unit.

Figure 6:
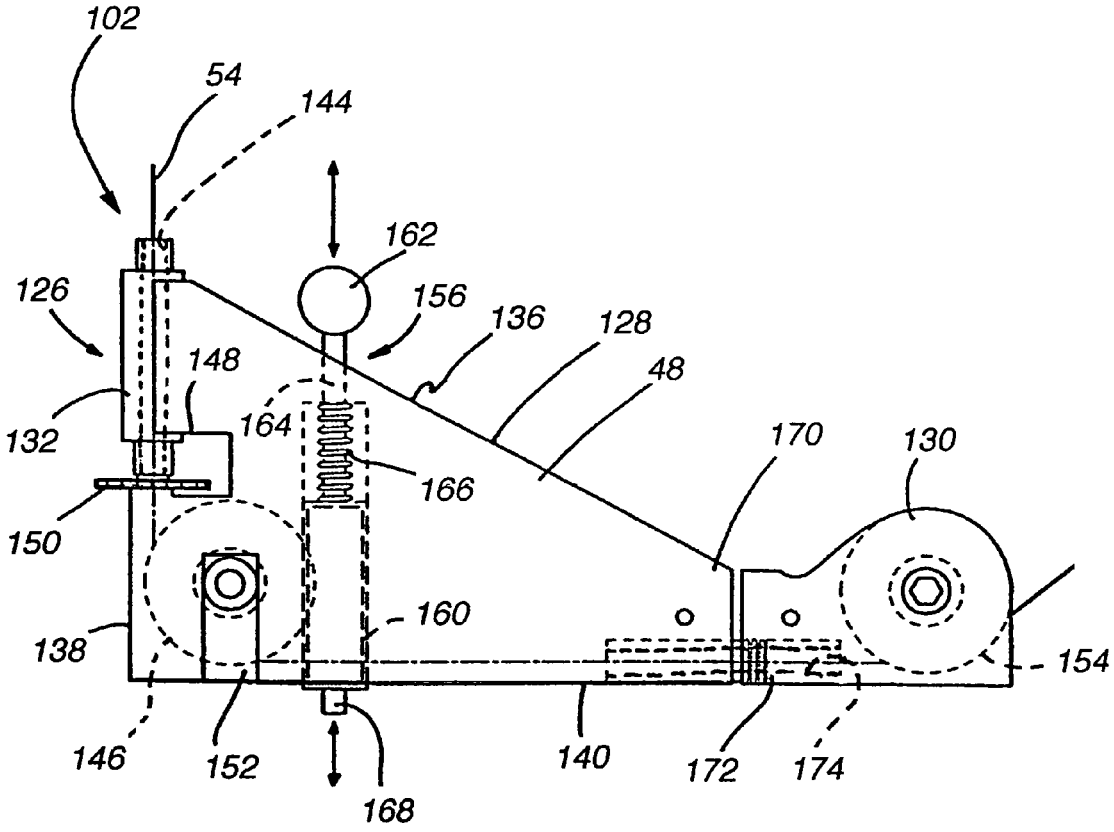
FIG. 6 is an enlarged view of the arm, including the arm bracket, end bracket, pivot structure, corner pulley, end pulley, and pop-pin structure.

Referring more specifically to FIG. 6, the arm 48 includes an arm bracket 128, an end pulley bracket 130, and a pivot mount 132. The arm bracket has a generally triangular shaped side plate 134 with a sloped top edge 136, a vertical side edge 138 and a horizontal bottom edge 140. (See FIGS. 6 and 7B). The top edge forms a surface that attaches the two side plates together. The vertical side edge and the bottom edge are open and not continuously attached together.

The pivot mount 132 (preferably tubular in shape with a hollow center) is formed in the arm bracket 128 on the vertical side edge 130 and is received by an upper and lower pivot retainer 142 (only one shown in FIG. 2) positioned on the end of the lateral beam 88 (see FIG. 6). The pivot retainers 142 are each preferably circular bosses with open centers. The pivot mount is attached to the pivot retainer, as is known in the art. This forms a pivot connection between the arm 48 and the frame 42 that defines an open channel 144 along the pivot axis through which the cable 54 passes. The pivot retainer is oriented vertically on the lateral beam, and the pivot mount engages the pivot retainer to allow the arm to pivot around a vertical pivot axis in the horizontal plane, preferably parallel to the support surface 58 the bench unit 40 is resting on. This allows the arm to pivot about an axis which is concentric with the extension of the cable through the pivot structure. The importance of this is discussed below.

Referring still to FIG. 6, the arm bracket 128 includes a corner pulley 146 which is positioned such that its outer circumference is substantially tangential with the vertical pivot axis.

A cutout 148 is formed along the vertical side edge 138 of the arm bracket 128. A chain gear 150 having a centrally-positioned aperture is attached in a horizontal orientation in the cutout, with its aperture aligned with the pivot axis to allow the cable to extend therethrough. The gear 150 is fixed to the arm bracket by welding or the like. The gear is used as part of a chain-drive system to coordinate the movement of the arms to corresponding proper positions, as described below.

Since the bottom edge 140 of the arm bracket 128 is open, a retainer 152 is attached across the open space between the side plates 134 to help keep the cable 54 on the corner pulley 146. Ideally, the retainer is attached to the side plates at a location that is closest to the location where the cable exits the corner pulley and extends toward the end pulley 154, thereby keeping the cable properly aligned on the pulley as the cable is pulled and retracted on the cable-pulley system.

A pop-pin structure 156 is used to hold the arm 48 in the desired position along its horizontal arc of motion (see FIG. 6). The pop-pin is spring-loaded, as is known in the art, and is positioned to extend vertically from the top surface 136 of the arm bracket 128 and selectively extend slightly out of the bottom edge 140 of the arm bracket to engage the position plate 158, as described below (see FIG. 3). Since the cable 54 extends along the bottom edge of the arm bracket, a pass-through retainer 160 (preferably rectangular in shape with an open center) is used to keep the pop-pin motion (up and down) from interfering with the cable. The pop-pin includes a handle 162 extending from the top of the arm bracket, a rod 164 extending from the handle through the arm bracket to the pass-through retainer, a spring 166 surrounding the rod, and a pin 168 extending from the bottom of the pass through retainer.

Figure 7C:
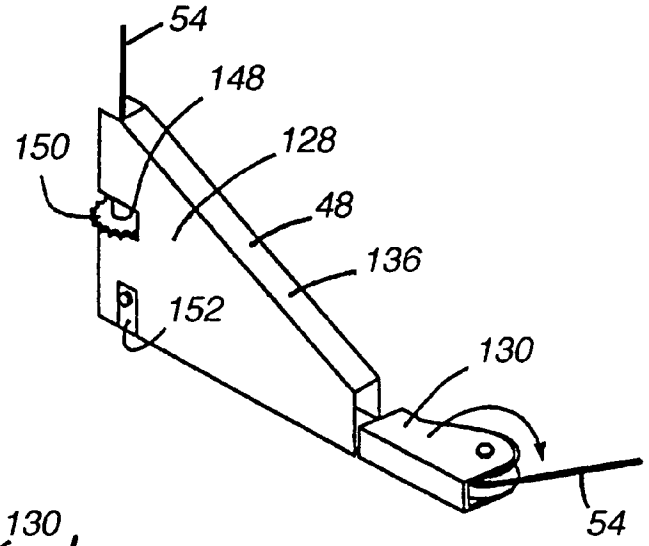
FIGS. 7*a-c* show various positions of the end bracket on the arm relative to the arm bracket.
Figure 7B:
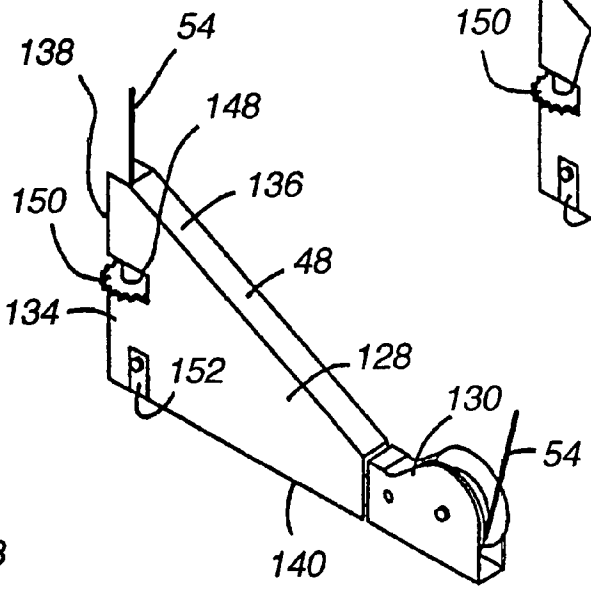
Figure 7A:
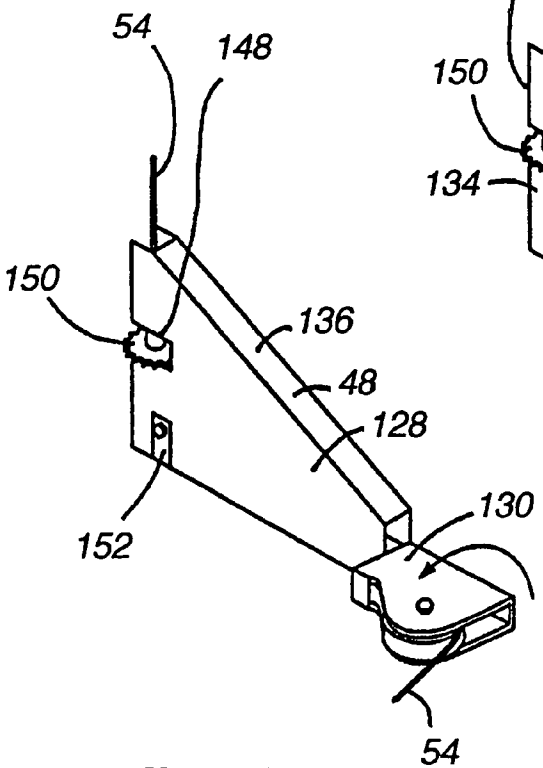

Still referring to FIG. 6, at the outer end 170 of the arm bracket 128, an end pulley bracket 130 is attached pivotally to the arm bracket to rotate along a horizontal axis (the longitudinal axis of the cable extension along the bottom of the arm bracket). The end pulley bracket includes an end pulley 154 whose circumference is substantially tangential and in alignment with the pivot axis of the end pulley bracket with respect to the arm bracket. The end pulley bracket is attached to the outer end of the arm bracket by a pivot structure 172 that also defines a channel 174 through the pivot axis. This pivot axis is oriented horizontally so the end pulley bracket pivots through a vertical arc. The cable extends through the channel formed in the pivot structure and engages at least a part of the end pulley. FIGS. 7A, B and C show the movement of the end pulley to keep the pulley in line with the direction of the cable 54.

Referring to FIGS. 1, 3 and 4, a position plate is mounted to the main member 64 of the frame adjacent the head end upright 70 and extends in an arcuate shape along the support surface and below the arm. The positioning plate has a plurality of holes formed therein for receiving the positioning pop-pin 156 of the arm bracket 128. The arm bracket is rotated about the pivot structure 102 on the lateral beam 88 to the desired position and then secured in place by positioning the pop-pin in the respective hole of the position plate for the desired position and exercise. To move the arm 48, the pop-pin is pulled upwardly to disengage the pin 168 from the hole until the new position is obtained. There can be a position plate mounted on either side of the frame 42, one for each arm. Or, if there is a system for simultaneously moving each arm (such as the chain drive system described below), the position plate can be mounted on one side only.

Many different types of pivot structures for attaching the arm to the frame are acceptable as long as the pivot structure 102 allows the arm 48 to pivot along the support surface 58 and the structure is strong enough to withstand the forces applied thereto. The pivot should ideally also allow the cable 54 to extend through the pivot structure along the pivot axis.

Figure 5:
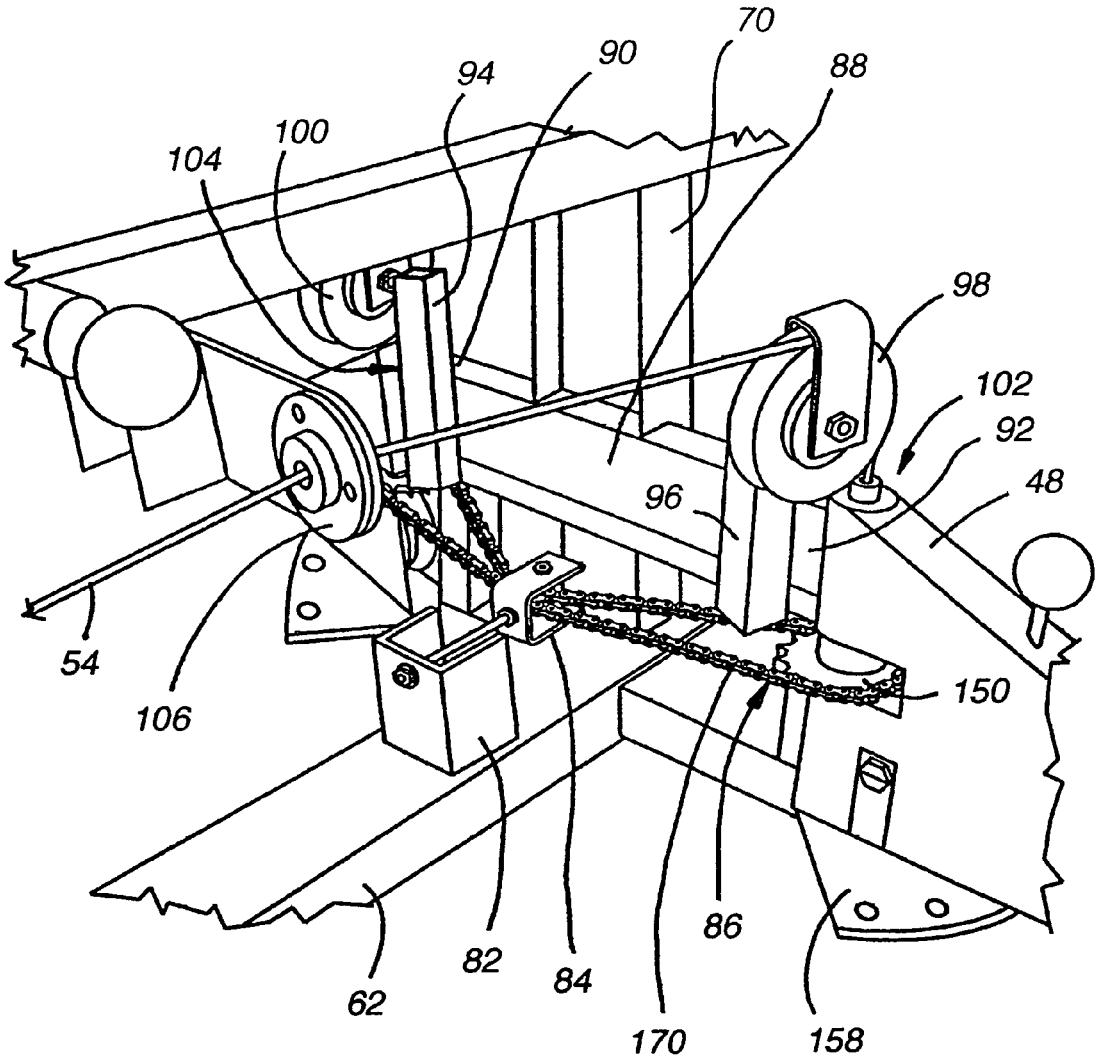
FIG. 5 is an enlarged view of the chain drive system (including the idler), as well as part of the cable/pulley system, in addition to the pivot structure between the arm and the frame.

Referring primarily to FIGS. 1 and 5, the chain drive mechanism 86 allows the user to adjust the position of one arm 48 along its arc of movement while at the same time moving the other arm correspondingly to the selected position. This keeps the user from having to separately move both arms and insures that the arms are similarly positioned.

The chain drive mechanism 86 includes the gears 150 attached to each of the arm brackets 128 (as described above) and a chain 170 extending therebetween. The chain extends in a "figure-8" around the two gears to make the "driven" arm move in the same direction as the "driving" arm. If the chain is simply looped around the gears, not in a "figure-8", the arms would move in opposite directions. An idler block 84 made of a smooth and sturdy material, such as plastic or the like, is mounted on the frame 42, under the top member 72, to tension the chain. Preferably, there is an idler block for each length of chain as it spans between the gears, and associated with each idler block is a channel through which the chain lengths each pass to keep the lengths of chain from interfering with one another. Because of the "figure-8" configuration of the chain, the lengths of chain between the gears cross over one another, and the channel structures keep the chain lengths separated. The idler blocks could be replaced with idler gears, but they are more expensive to assemble. Any structure that keeps the chain tensioned and allows it to move relatively freely is an acceptable idler structure.

With the chain drive system 86 in place, when one arm 48 is moved (the "driving arm"), the other arm (the "driven arm") also moves to the proper desired location. The chain drive system also eliminates the need to have a separate securing mechanism 158 for the "driven" arm. The chain engagement with the gears 150 that are attached to the arm brackets 128 securely holds the "driven" arm in the proper position without the need for a separate positioning plate 158. A separate positioning plate can be used if desired, but is not required.

It is contemplated that the arms 48 could also be constructed to move in two or three dimensions instead of the one dimensional movement now allowed by the described structure. This would provide for an increased number of positions to allow for different exercises. The structural means for allowing the arms to move in two or three dimensions are currently available to one of ordinary skill in the art.

The resistance engine 52, as shown in FIG. 1, is positioned at the front end of the frame and generally below the seat bottom 44, near the cross member 62, between the first 68 and second 70 upright support posts. The resistance engine includes a mechanism that allows for adjustable load resistance settings in the embodiment shown in FIG. 1. The resistance engine extends laterally from the frame 42, and is below the plane of the seat bottom 44, and extends outwardly approximately as far as the cross member 62. Different types of constant load (isotonic) resistance engines could be used, such as constant force or constant torque springs, or linear springs (in conjunction with a mechanical advantage compensation mechanism). Preferably, the resistance engine used in the bench unit 40 is that shown in U.S. Pat. Nos. 5,209,461; 4,944,511; or 6,126,580, hereby incorporated in their entirety by reference. Another resistance engine that could be used is shown in U.S. Pat. No. 4,363,480, also incorporated herein by reference.

The preferred resistance engine, as described in more detail below is attached to a cable pulley system to allow the user to exercise by grasping the cables and working against the resistance engine by pulling the cables. The cable 54 is strung from the resistance engine 52 through a plurality of pulleys and guides to the arms 48. The free end 176 of the cable has a handle 178 attached thereto. As referenced above, the arms are able to be adjusted to various positions to allow the user to perform different exercises such as, but not limited to, bench press, row, curls, flies, lunges and incline bench. These different exercises can be performed by simply repositioning the arms with respect to the frame and adjusting the seat structure as desired.

The resistance engine 52 is made up of a plurality of packs as described in the incorporated references above. Each pack is generally a disk and has an interconnected rubber or elastomeric band on either side. A plurality of packs are each attached in series, with only one band of the end pack being attached to a shaft which is positioned through but not connected to the center of each of the packs. The innermost pack is attached to the spiral pulley. The force or load sensed by the user is set by the pre-load mechanism.

Figure 8:
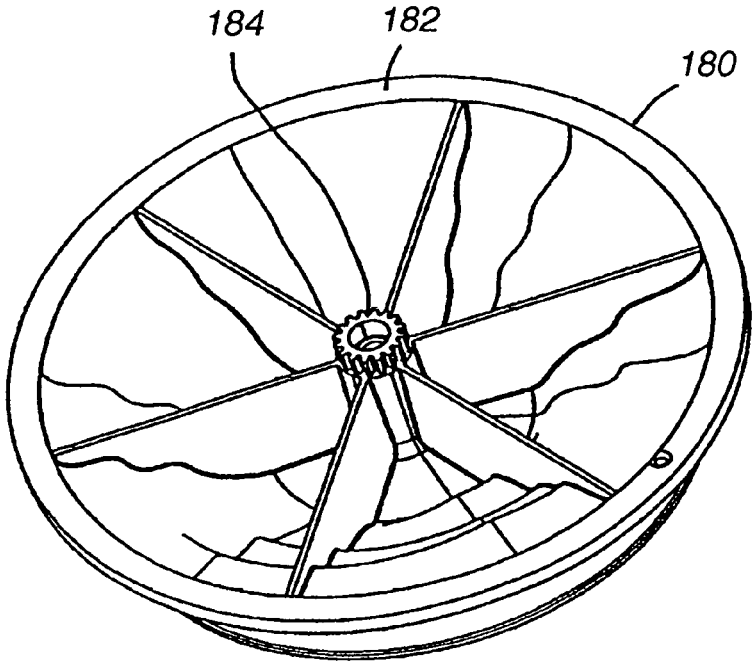
FIG. 8 is a perspective view the spiral pulley.
Figure 9:
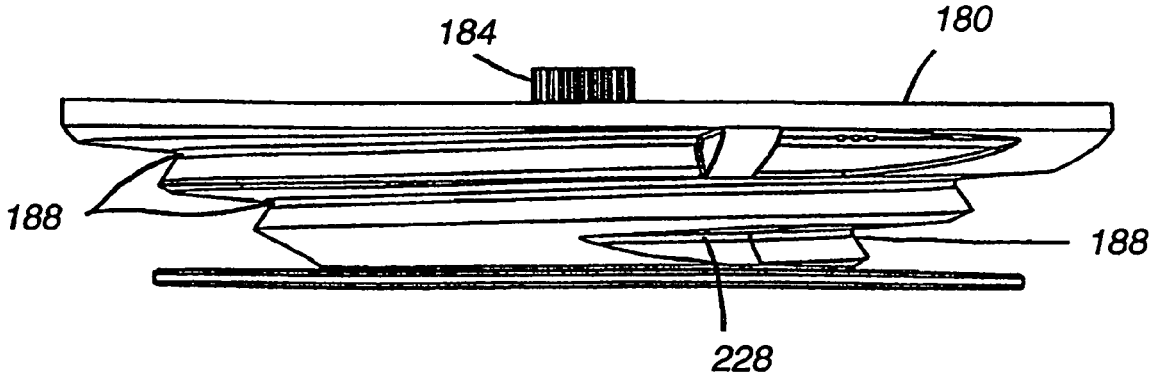
FIG. 9 is a side view of the spiral pulley.
Figure 10:
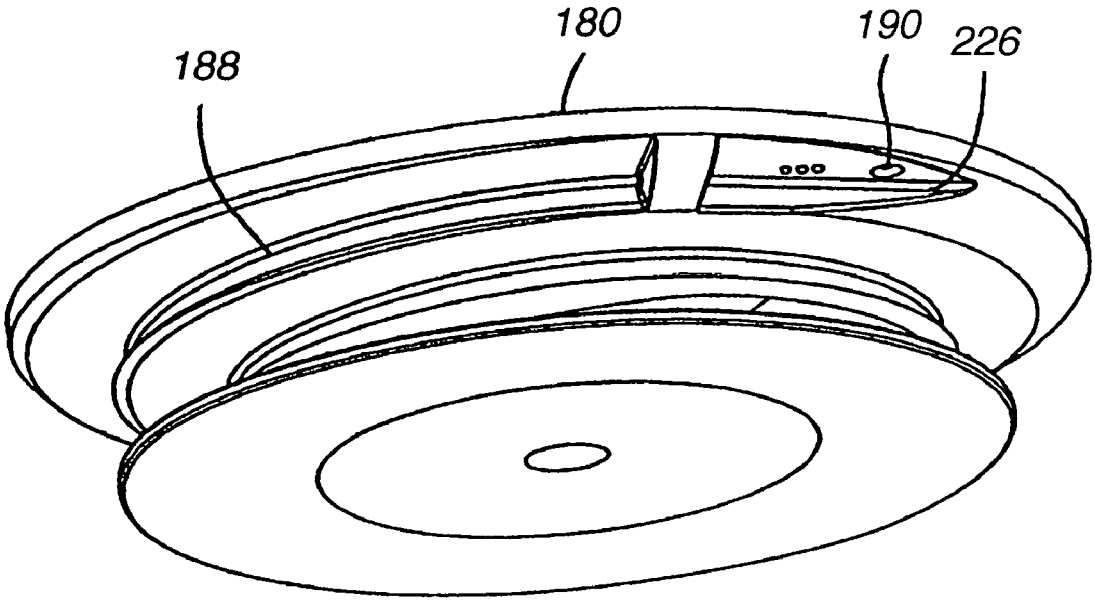
FIG. 10 is a different perspective view of the spiral pulley.

The spiral pulley 180 is shown in more detail in FIGS. 8-10. FIG. 8 shows a front perspective view of the pulley, the front side 182 being the side closest to the packs. The splined shank 184 on the front side of the spiral pulley engages the splined hub 186 of the elastomeric band member of the adjacent pack, which is described in greater detail below. FIG. 9 shows a side view of the spiral pulley 180 with the spiral track 188 for the cable defined therein. FIG. 10 shows a rear perspective view of the pulley, further detailing the spiral track and the aperture 190 to which the cable end 192 (see FIG. 1) is attached. The spiral track is designed in the spiral pulley to compensate for the non-constant (or non-isotonic) increasing load created by the elastomeric spring force, which occurs when the cable 54 is extended by the user. Without the spiral pulley, the load increases with the amount the cable is extended further by the user. The spiral pulley compensates to create a substantially flat constant load by increasing the moment arm (by increasing the diameter at which the cable is attached to the pulley to increase the leverage) as the cable is pulled outwardly during the exercise. Thus, the spiral pulley in combination with the resistance engine may comprise a means for providing a constant load to a user.

The first end 192 of each cable 54 in the cable pulley system is attached to the appropriate spiral pulley 180 at the large radius end 226, and the cable is wrapped around the decreasing diameter until it extends rearwardly toward the fairload 106. As the cable is extended by the user the cable follows the cable path 188 formed in the spiral pulley in an ever-increasing radius to offset the ever-increasing load to create a near constant load through the entire exercise motion. The opposite end 176 of each cable is attached to a handle 178 of some sort for use by the exerciser.

Figure 11A:
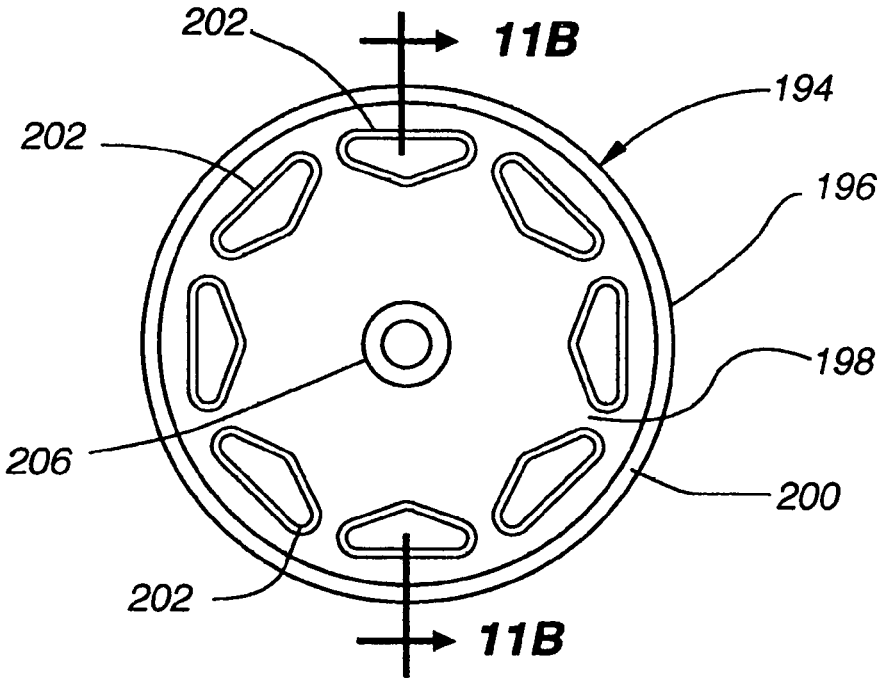
FIG. 11*a* is a side view of the plate housing, showing the hangers and the central hub.
Figure 11B:
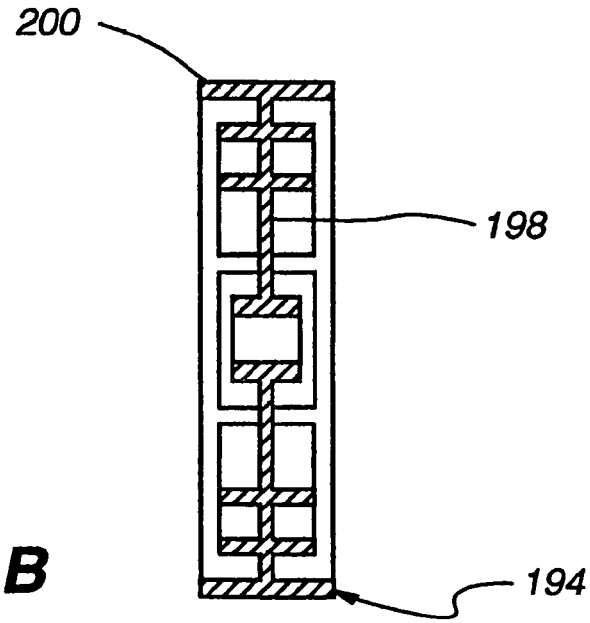
FIG. 11*b* is a section view taken along line 11*b*-11*b* of FIG. 11*a*.
Figure 11C:
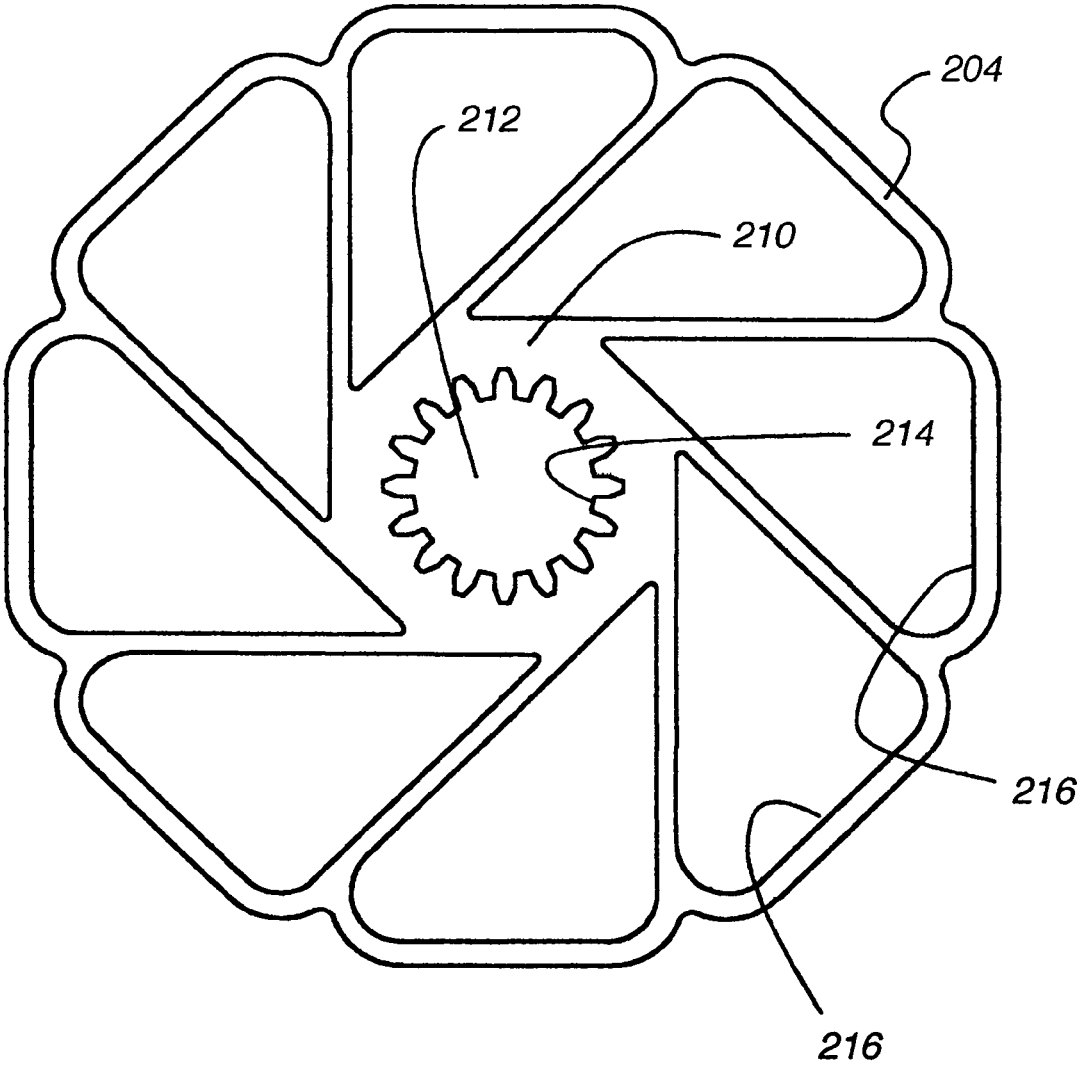
FIG. 11*c* is a view of the elastomeric spring structure, showing the splined hub and extending loops for use on the plate housing.
Figure 12C:
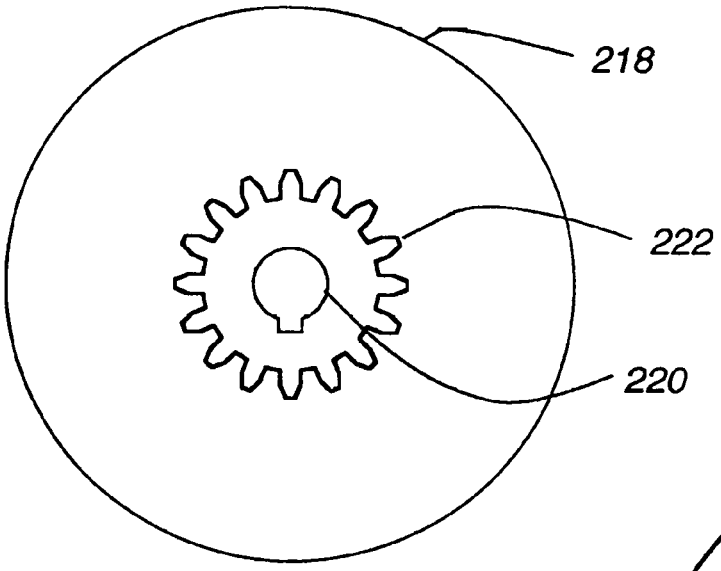
FIGS. 12*a-c* show the spline plate for use in connecting between elastomeric spring structures.
Figure 12B:
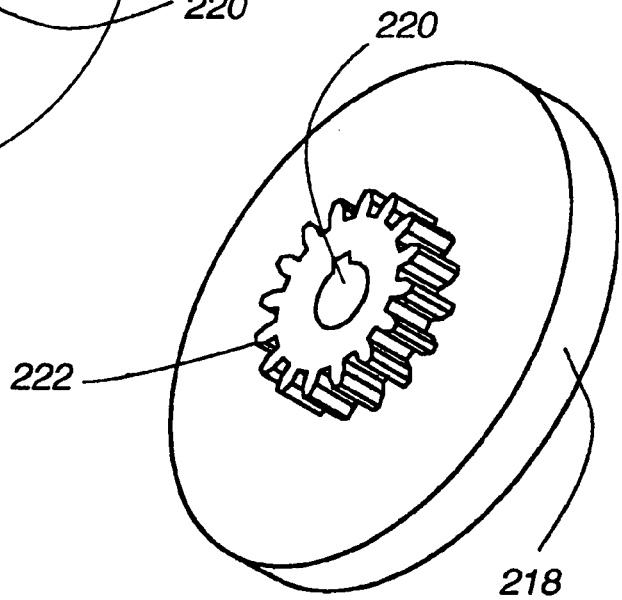
Figure 12A:
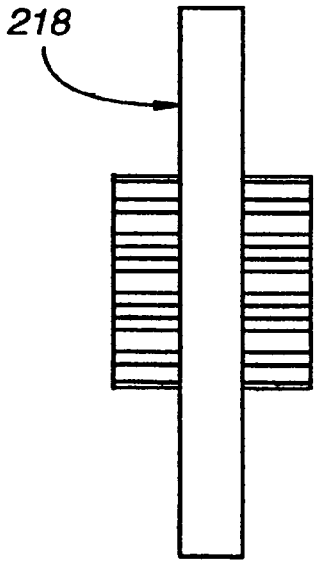

Referring to FIGS. 1, 11, and 12, the resistance engine 52 includes a series of packs 194 extending from each side of the frame 42. Each series of packs is preferably identical, so only one side is explained hereinafter. A pack includes a circular housing 196 having a central disk-shaped body 198 and a rim 200 extending to either side of the disk at the circumference. A plurality of hangers 202, preferably eight, are formed on either side of the disk just inside of the rim, and are equally spaced. Each hanger evenly distributes stress and avoids abrading the spring 204.

A hub 206 is formed in the housing for receiving the shaft 208 (see FIG. 13), as explained below, to allow the housing to rotate on the shaft. A rubber (elastomeric) spring or band 204 is positioned on each side of the housing. Each rubber spring has a central hub 210 defining an aperture 212 with a splined inner diameter 214 that is larger than the outer dimension of the hub 206 on the housing 198. Extending outwardly from the hub 214 are a plurality of lobes or loops 216, one for each hanger. The loops each extend around and are held in slight tension by the hangers.

A splined connector disk 218 (see FIGS. 12A, B and C) is used to connect the hub 210 of the spring of one pack 194 with the hub 210 of a spring of the adjacent pack 194. The disk 218 has a central aperture 220 defined through a splined hub 222 which extends outwardly from either side o the disk. The splined hub 222 is received in the splined central aperture 212 of the adjacent spring, thereby interconnecting the hubs of the adjacent springs in a torque-transmitting relationship. The hub 222 of the disk 218 is positioned over the hub 206 of the housing 196. The disk part spaces adjacent packs apart a minimum amount so the housings do not interfere with one another.

The spiral pulley 180 and the packs 194 are positioned over but not attached to the shaft 208, and are interconnected together with the splined connector disks 218. The first pack, nearest the spiral pulley, is attached to the spiral pulley by the splined hub 184 on the outside wall 182 of the spiral pulley. Four more packs (in this embodiment) are positioned over the shaft. All of the spring hubs of the packs, except the first and last springs, are connected to adjacent spring hubs using the connector disks. The hub of the outermost spring on the outermost pack is attached to the outer end of the shaft 224 as an anchor, against which the load is created (see FIG. 1).

The cable/pulley system interacts with the resistance engine 52 through the spiral pulley 180. The cable 54 is attached to the spiral pulley at its outermost, largest diameter location 226 and wrapped along the cable path 188 to the innermost, smallest diameter location 228. As the cable is tensioned (by extending the cable), the spiral pulley is rotated about the shaft 208 (the shaft does not, however, rotate) which in turn causes the attached first spring 204 on the first or innermost pack 194 to rotate. Because the first spring is attached to the hangers 202 on the first side of the housing 196 of the first pack, the movement of the housing causes the second spring 204 on the first housing to rotate since it is attached to the hangers on the second side of the first housing. The hub 210 on the second spring on the first housing is attached to the hub of the first spring on the second housing by the spline plate 218, which in turn starts to rotate around the shaft. This continues in series through each of the packs until the outermost pack, which has the outermost spring attached to the shaft at the hub of the spring as an anchor (see FIG. 1). This anchor point provides the fixed end against which the bands are stretched, which creates the load felt by the user.

Thus, as the cable is extended, the spiral pulley 180 rotates and further stretches the springs in the packs to create the pre-set load felt by the user. The packs 194 all rotate in a direction to increase the load which results in work being done by the user by actuating the cable pulley system. The load felt by the user is affected by several factors, including the modulus of the spring material, the spring design, and the pre-load on the resistance engine 52.

The spiral pulley 180 linearizes the load through the entire range of motion of the exercise. Without the spiral pulley, the load would increase as the displacement of the cable increases since elastomer springs are used to create the load. However, it is desirous to have a relatively constant load throughout the range of motion of the exercise for certain applications, thus the use of the spiral pulley. This beneficial constant, isotonic load is described in more detail below.

Figure 13:
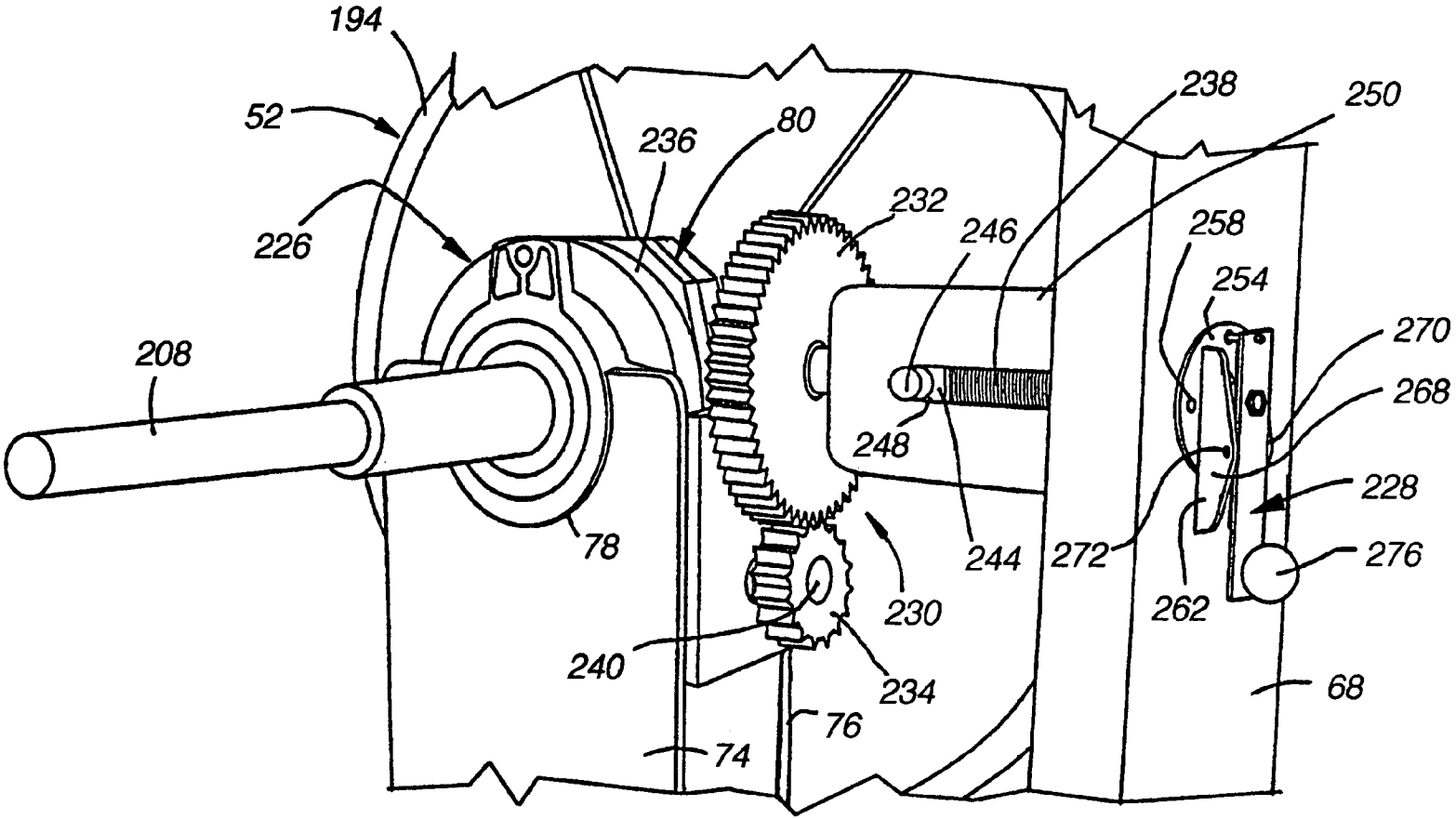
FIG. 13 is an enlarged view of the pre-load mechanism with one side of the resistance engine removed.
Figure 14:
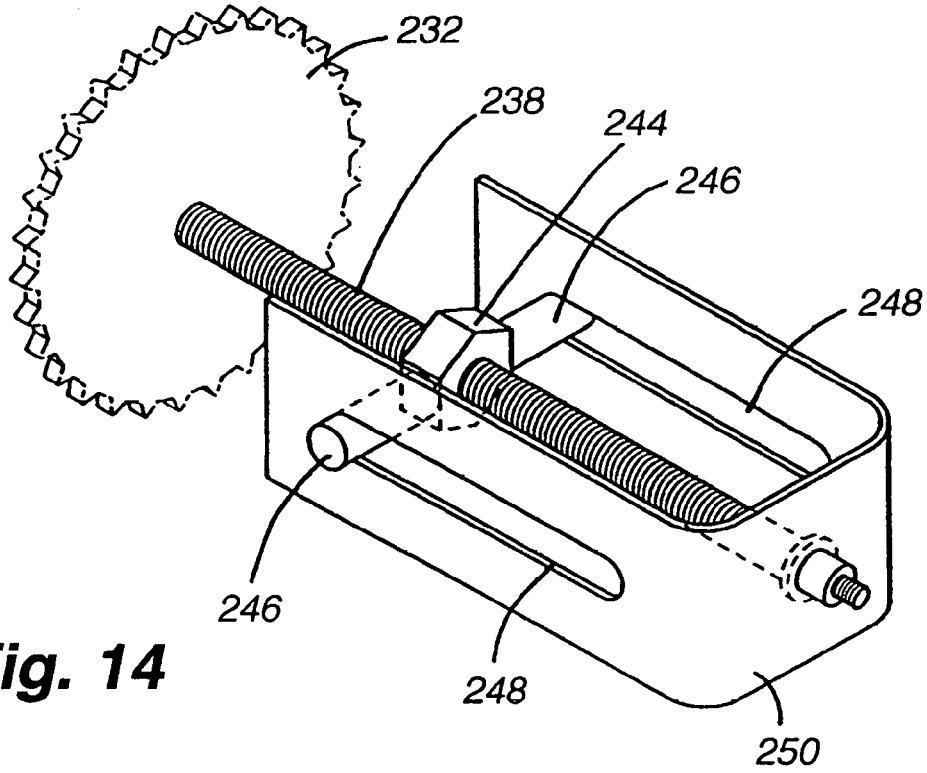
FIG. 14 is a partial view of the pre-load mechanism limit device in an extreme position.
Figure 15:
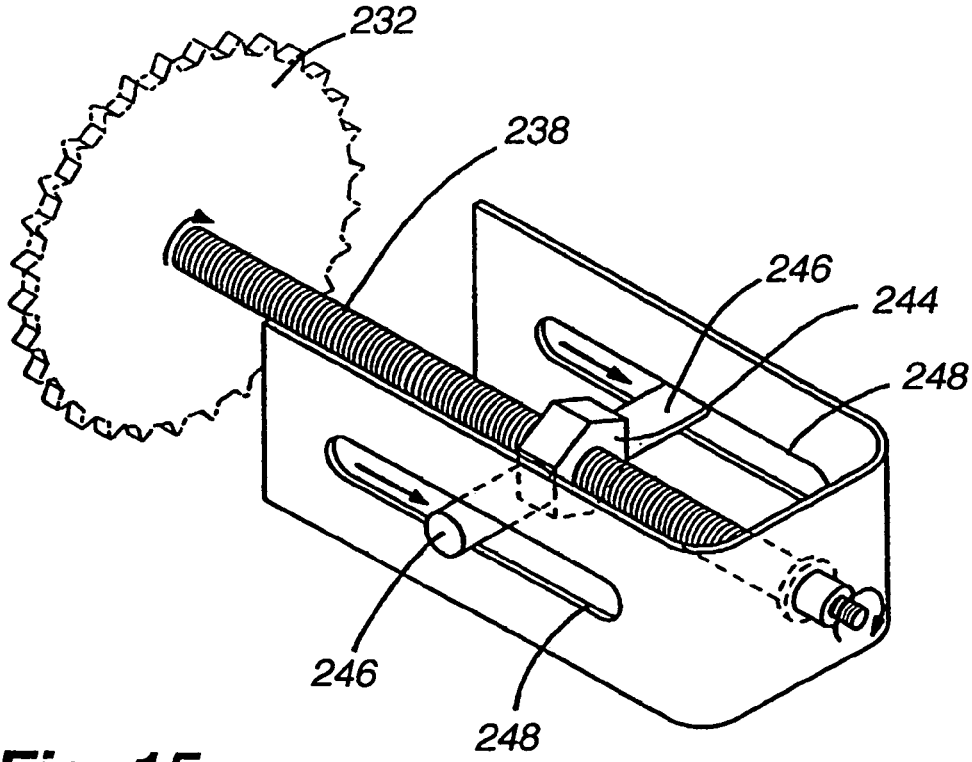
FIG. 15 is a partial view of the pre-load mechanism limit device in an intermediate position moving toward the opposite extreme position.

The resistance engine 52 is pre-loaded to the desired load for the given exercise. The user can increase or decrease the pre-load as desired. The pre-loading action basically partially winds up the springs 209 in the packs 194 by rotating the shaft 208, as opposed to the above description of a load being used by rotating the packs relative to the shaft. Referring to FIGS. 13, 14 and 15, the pre-loading mechanism 80 or means for adjusting the load provided by the resistance engine is shown. The pre-loading mechanism 80 attaches to the foot end of the frame 42, adjacent the resistance engine 52. The mechanism mounts on the mounting brackets 74 and 76. The pre-loading mechanism is actuated by a crank arm 228 extending through the foot-end upright member 68 of the frame. The pre-load mechanism includes a gear-reduction train 230 having a primary drive gear 232 driving a slave gear 234, with the slave gear driving a worm-gear assembly 236. The crank is attached to a threaded drive shaft 238 that extends through the front upright member to the primary drive gear, which is positioned behind the front upright member and adjacent the worm-gear assembly. The primary drive gear 232 is engaged with the slave gear 234 which axis is attached to a shaft 240 that extends into the worm-gear assembly 236. The drive gear is larger than the slave gear to give the user a mechanical advantage in actuating the worm-gear assembly.

In the worm-gear assembly 236, a worm-gear (not shown) (on the shaft attached to the slave gear) turns another gear (not shown), that in turn rotates the laterally-extending shafts 208 on which the resistance engine packs 194 are mounted. The packs 194 are then rotated around the shaft (by the shaft rotating), and the anchor in this situation is the cable-stop 242 attached at the end 176 of each cable 54, against which resistance, or a load, is established.

A suitable worm-gear assembly is Series 520, Style H, Aluminum Worm Gear Speed Reducer, 26:1 made by Leeson Electric Corporation.

The maximum and minimum pre-load are determined by a follower 244 positioned on the threaded drive shaft 238 attached to the crank 228. The internally threaded follower 244 has two pins 246 extending therefrom that each slide in a slot 248 defined in a frame 250. See FIGS. 14 and 15. When the pin 246 reaches either end of the slots 248, the threads bind and the crank arm is no longer able to be turned. This indicates the highest or lowest pre-loading scenario. See FIG. 14.

Figure 17:
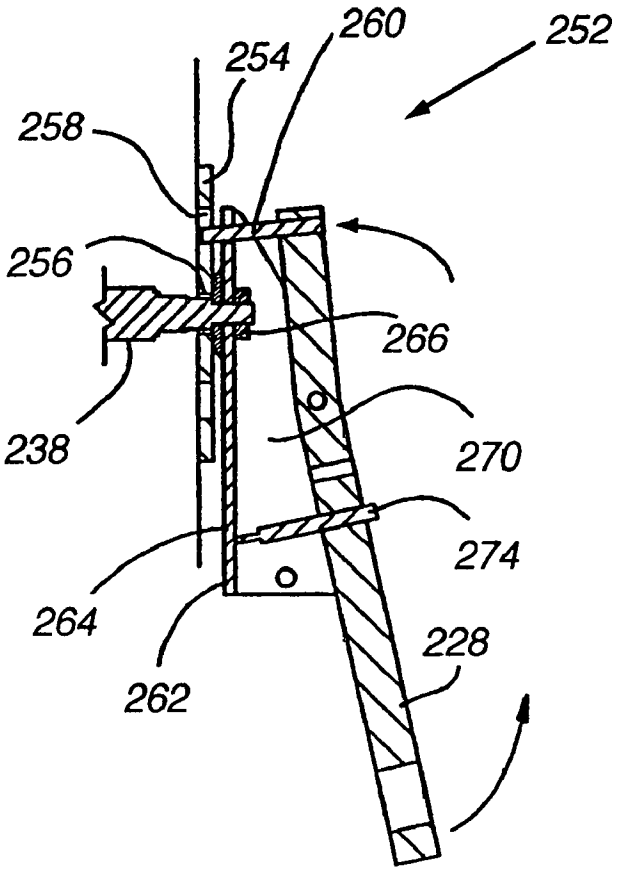
FIGS. 16 and 17 are views of the pre-load locking mechanism in the unlocked and locked forms, respectively.
Figure 16:
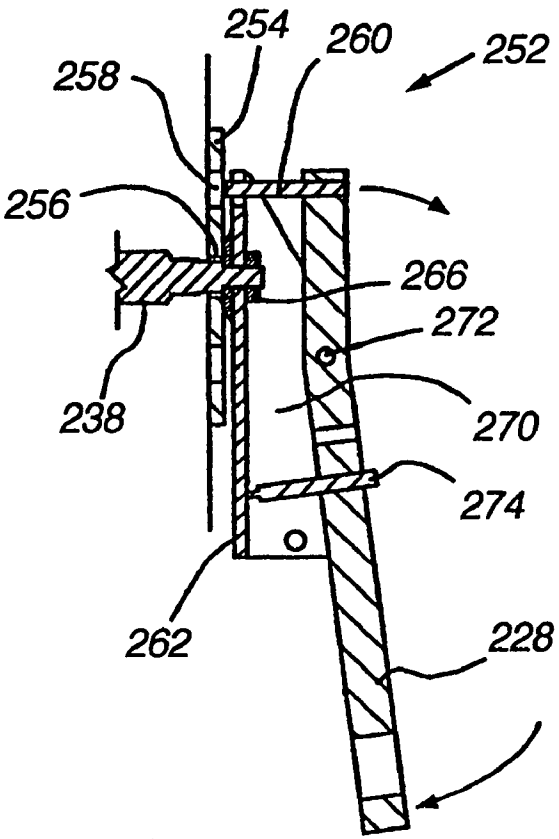

In order to keep the pre-load from changing during the use of the machine, which would be caused by the shaft 208 unwinding as a result of the cables 54 being extended, which would cause the worm-gear (not shown) to unwind, which in turn would make the crank arm 228 unwind, a lock structure 252 is used to keep the crank arm from unwinding. Referring to FIGS. 13, 16 and 17, a locking plate 254 is attached to the front of the foot-end upright member 68. The plate defines an aperture 256 used to support the front end of the drive shaft 238 that is used to turn the drive gear 232 on the pre-load mechanism 80. A plurality of slots or holes 258 are formed around the perimeter of the aperture, either separate from or as part of the aperture. FIG. 13 shows the slots being separate from the aperture. The slots are positioned at any desired interval, and preferably every 90 degrees around the aperture. The slot receives a pin 260 on the end of the crank arm, the crank arm being normally biased so that the pin is inserted into one of the holes to keep the crank arm from unwinding.

Referring still to FIGS. 13, 16, and 17, the crank arm 228 is attached to the drive shaft 238 by a three-sided bracket 262. The bracket defines a bottom wall 264 that is attached to the end of the drive shaft by a nut 266. The two side walls 268 and 270 extend away from the bottom wall and are parallel to each other. The two side walls define a pivot 272 to which the crank arm is attached. The crank arm is attached to the pivot point 272 to move about the pivot point toward and away from the bottom wall. The crank arm has a pin 260 extending out of one end for positioning in one of the slots 258 formed in the locking plate 254. The crank arm has a spring-loaded pin 274 extending out of its body at about the half-way point along its length to engage the bottom wall of the bracket. The location where the crank arm is attached to the pivot point is approximately half-way between the locking pin 260 and the spring-loaded pin 274. The spring loaded pin biases the crank arm in a manner to keep the locking pin in one of the slots formed in the locking plate.

To unlock the pre-loading mechanism 80, the handle 276 of the crank arm 228 (see FIG. 13) is pressed toward the machine to compress the spring-loaded pin 274 and extract the locking pin 260 from the locking plate 254 (see FIG. 16). Held in this position, the crank arm can then be rotated to adjust the pre-load. When the pre-load is set properly, the user rotates the crank arm to the nearest slot and releases pressure on the handle to allow the spring-loaded pin to bias the locking pin into the selected slot. See FIG. 17. The crank arm can have a bend formed in it, with the apex adjacent the pivot point. This makes the crank arm easier to use when in the compressed position since it will then extend at substantially right angles to the drive shaft for easier turning.

The cable/pulley system includes the cable 54 extending from the spiral pulley 180 and the various pulleys mounted on the frame 42 to direct the cable. In particular, referencing FIG. 1, the cable/pulley system includes the spiral pulley, the fairlead 106, the top pulley 100, the corner pulley 146, and the end pulley 154 for each cable. Each cable is attached at one end to the largest diameter 226 location on the spiral pulley, extends rearwardly through the fairlead, bends outwardly to the top pulley, bends downwardly to pass through the pivot 102 to the corner pulley, and bends outwardly again to pass through the pivot to the end pulley, and then bends in whatever direction necessary for the desired exercise.

The alignment of the top pulley 100 and the corner pulley 146 to have the cable 54 extend concentric with the pivot axis minimizes the torque applied to the end of the arm structure 48 such that the arm will stay in the desired position more easily, and not be biased towards any one position. In addition, the cable is less likely to become misaligned on a pulley. The same is true for the alignment of the end pulley and corner pulley with the pivot axis between the pulley bracket 130 and the arm bracket 128.

The fairlead 106 acts to redirect the cable 54 extending from the spiral pulley 180 to the top pulley 100. Since the cable moves along the length of the spiral pulley as the pulley is rotated, and the cable infeed to the top pulley must be in line with the rotation of the pulley, the fairlead acts to allow the cable to move laterally and vertically while at the same time keeping the infeed of the cable to the top pulley in alignment with the top pulley.

The fairlead 106 can be two horizontal rollers and one or two vertical rollers to "condition" the position of the cable 54 at the output of the fairlead. The fairlead could be replaced by an hourglass-shaped aperture which would have no moving parts and have a Teflon coating to allow the cable to move through the hourglass-shaped structure with minimal abrasion. The fairlead can also be a grommet or disk having an inner beveled diameter. See FIG. 5. In this latter instance, the fairlead is best made out of hard coat anodized aluminum to minimize wear on the cable and provide a hard, smooth, wear-resistant surface. The effect of all three embodiments would be the same in that the cable infeed to the top pulley 100 would be directed in alignment with the rotation of the pulley. The details of the cable/pulley system are discussed below.

The free end 176 of the cable 54, which the user grasps, includes a ball-stop 242 to keep the free end from retracting along the cable/pulley path. The ball becomes jammed between the end pulley 154 and the end pulley bracket 130. The ball is clamped on the cable 54 to make sure that the handle 178 is accessible to the user. However, the attachment at the end pulley is not fixed, and allows the user to grasp a handle attached to the end of the cable and extend the cable from that point for exercising. Other types of termination of the free end of the cable could also be used. This termination structure keeps the cable from being pulled back through the cable pulley system. The termination structure and the pre-load lock 252 form the terminal ends of the spring load system (resistance engine 52) that can be loaded from either end.

The cable used in the cable/pulley system is preferably a 4.3-4.6 mm diameter, polyester-core, nylon-sheath black cord with a medium stiffness braid and having 1% elongation over 100 pounds of load. Other types of rope, cord, or coated steel cable would also be acceptable.

Figure 18:
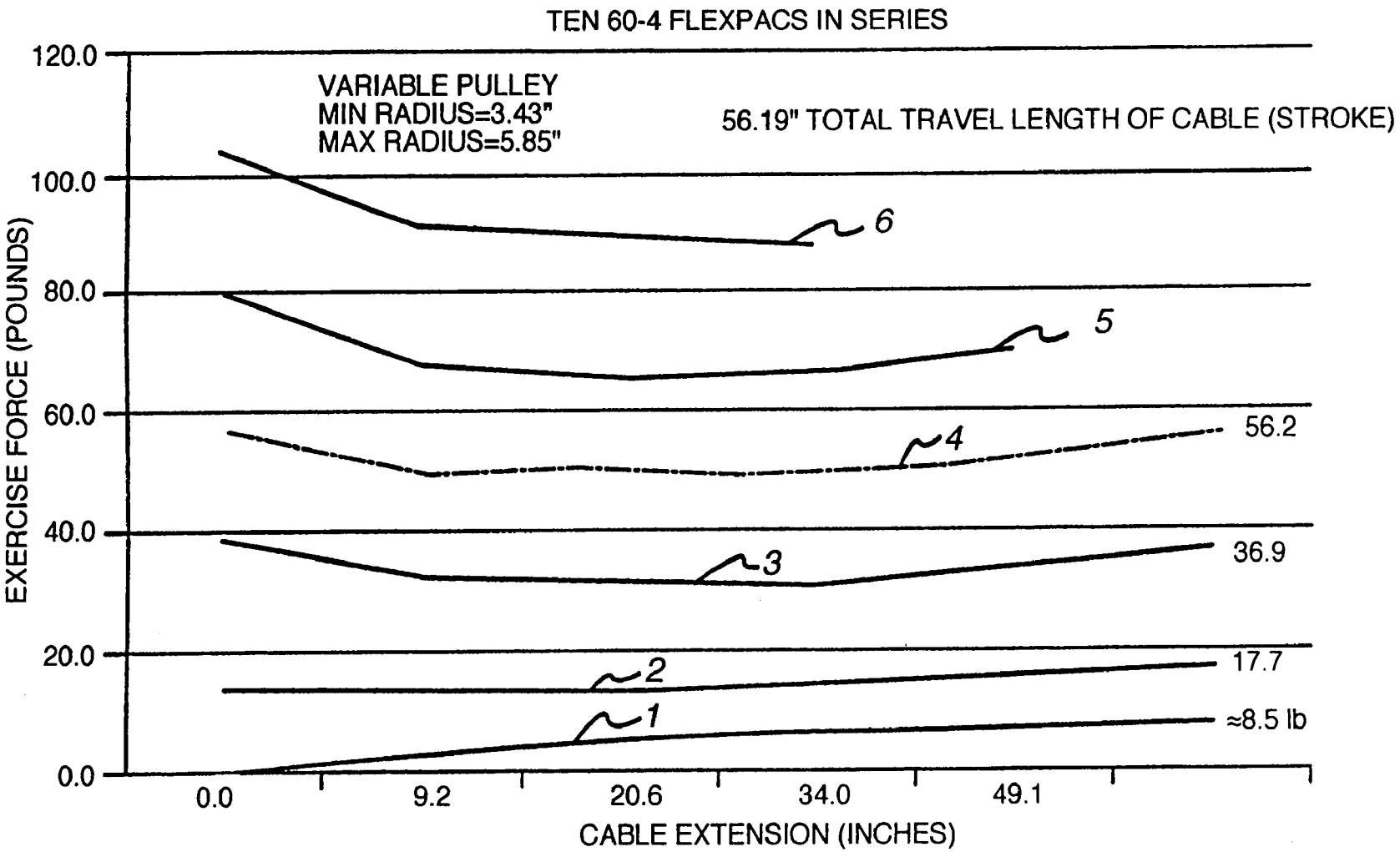
FIG. 18 is a graph showing the constant load levels upon full extraction of the cable given the pre-load force.

FIG. 18 shows the linearity of the resistance engine 52 through the total exercise motion when the user is using the bench unit 40. The exercise motion is the same as or less than the total travel length of the cable, which is preferably 58.19". The minimum radius of the spiral pulley 180 is approximately 3.43" and the maximum radius of the spiral pulley is approximately 5.58". Both the minimum and maximum radii, and the number of rotations of the pulley needed to transition from the smaller to the larger radius is able to be changed depending on the non-linearity of the resistance engine loading.

In the instant preferred embodiment, with the variable pulley as noted above, with the zero pre-load on the resistance engine 52, by pulling the cable 84 to its total length the force on the cable goes from zero to approximately 8.5 pounds. See line 1 in FIG. 18. Looking at line 2 in FIG. 18, the pre-load is approximately 14 pounds and at full extension of the cable, the force on the cable is approximately 17.7 pounds. Line 3 shows the load changing from 38.3 pounds to 36.9 pounds between the zero extension point and full extension point of the cable. Line 4 of FIG. 18 shows the load changing from 56.7 pounds to 56.2 pounds from no extension of the cable to full extension of the cable. Lines 5 and 6 also accordingly show the relatively level, constant load felt by the user on the cable during exercise. The initial point of the line on the graph represents the pre-load applied to the resistance engine by the pre-load mechanism 80 as described above. The linearity of these various force lines on FIG. 18 is created by the spiral pulley 180 and its varying radii for the cable 54. Again, as the pulley is turned under the force of the cable during an exercise, the cable travels to higher and higher radius on the pulley, which increases the cable's leverage (mechanical advantage) on the resistance engine to counteract the increasing load created in the resistance engine (due to the spring-like nature of the elastomer springs).

The bench unit 40 of the present invention thus has several beneficial features. The first being that the resistance engine 52 has an adjustable pre-loading level to allow the user to select a preset loads to be applied to the cable pulley system for a particular exercise. This preset load is kept relatively constant through the stroke of the exercise (through the extension of the cable in whatever form the user desires) and is beneficial for various exercises. This constant load closely replicates the effect of free-weights. A sense of inertia is also provided due to the movement of the resistance engine, which further replicates the free-weight lifting experience.

The pre-load can be set from zero to approximately 100 pounds, given the preferable type of resistance engine 52. However, this pre-load can be adjustable up to any reasonable level with the use of the appropriate resistance engine. The pre-load resistance is set easily by the use of the crank arm and the pre-load mechanism described above. It is contemplated, however, that no pre-load function is required of the resistance engine. This would simply create a bench unit 40 with an increasing load through the exercise stroke.

Another beneficial point of the exercise bench unit 40 is that a variety of different exercises can be performed because of the reconfigurability of the seat structure as well as the arm structure 48. The cable pulley system is integrated into the arm structure, frame 42, and resistance engine 52 such that when the arms are positioned in the particular location by the user, certain exercises can be performed. The cable pulley system is designed to minimize residual torque on the arms by the positions of the various pulleys in line with the pivot points on the arm.

The bench unit 40 also is portable when tipped on its end, and is easily storable. It also includes a standing support platform 50 for even more variety of exercises. This bench unit also allows a user to select a load which is greater than the weight of the entire piece of equipment.

A variety of exercises can be performed on the bench unit 40. The arms are simply positioned as desired, and the cable ends 176 (second cable end of each of the two cables) pulled through its full extension. Handles 178 for gripping by a user's hands, as well as straps or other types of attachments can be used for other types of exercises, such as lower body exercises.

A shroud can be used to cover the moving parts of the resistance engine and cable pulley system if desired. The shroud would extend outwardly to cover the laterally extending resistance engine, thus forming tubular lobes. The shroud would continue rearwardly to cover the underside of the bench if desired. A window could be formed in one of the lobes to allow the user to see an indicator positioned on the resistance engine (such as on the circumference of one of the packs), the indicator being calibrated to show the pre-load force.

While the invention has been particularly shown and described with reference to a preferred embodiment thereof, it will be understood by those skilled in the art that various other changes in the form and details may be made without departing from the spirit and scope of the invention.

We claim:

1. An exercise unit comprising:
a frame;
a seat positioned on said frame;
a resistance engine attached to said frame and utilizing elastomere springs;
an actuator attached to said resistance engine wherein said resistance engine provides a constant load to a user when said actuator is actuated, and wherein said actuator comprises a cable;
means for adjusting the load provided by the resistance engine, the means for adjusting being continually engaged with the resistance engine.

2. An exercise unit as defined in claim 1, wherein said means comprises a rotary crank.

3. The exercise unit as defined in claim 1, further comprising at least one adjustable position arm structure attached to the frame.

4. The exercise unit as defined in claim 3, wherein the at least one adjustable position arm structure is configured to cooperate with the actuator to adjust a position of the actuator.

5. The exercise unit as defined in claim 4, wherein the at least one adjustable position arm structure includes an integral cable guide structure.

6. The exercise unit as defined in claim 4, wherein the at least one adjustable position arm structure includes at least one pulley configured to guide the cable.

7. The exercise unit as defined in claim 3, wherein the at least one adjustable position arm structure comprises two adjustable position arm structures extending outwardly from opposite sides of the frame.

8. The exercise unit as defined in claim 1, wherein:
said actuator is configured to compensate for a non-constant force of the elastomere springs.

9. The exercise unit as defined in claim 8, wherein:
said actuator includes a spiral pulley configured to compensate for the non-constant force of the elastomere springs.

10. The exercise unit as defined in claim 1, wherein:
said resistance engine and at least part of said actuator are located below said seat.

11. The exercise unit as defined in claim 10, wherein:
said frame defines a bench exercise unit.

12. The exercise unit as defined in claim 10, wherein:
said at least part of said actuator is configured to compensate for a non-constant force of the elastomere springs.

13. The exercise unit as defined in claim 12, wherein:
said at least part of said actuator includes a spiral pulley.

14. The exercise unit as defined in claim 1, wherein:
said resistance engine and at least part of said actuator are located at least partially beneath said seat.

15. The exercise unit as defined in claim 14, wherein:
said at least part of said actuator is configured to compensate for a non-constant force of the elastomere springs.

16. The exercise unit as defined in claim 15, wherein: said at least part of the actuator includes a spiral pulley.

17. An exercise unit comprising:
a frame;
a seat positioned on said frame;
means for providing a constant load to a user, said means attached to the frame and utilizing resilient bands;
an actuator attached to said means for providing a constant load; and
means for adjusting the load provided by the means for providing a constant load, the means for adjusting being continually engaged with the means for providing a constant load.

18. An exercise unit as defined in claim 17, wherein:
said means for providing a constant load are located below said seat.

19. An exercise unit as defined in claim 18, wherein:
said frame defines a bench exercise unit.

20. An exercise unit as defined in 17, wherein:
said means for adjusting comprises a crank arm.

21. The exercise unit as defined in claim 17, further comprising at least one adjustable position arm structure attached to the frame.

22. The exercise unit as defined in claim 21, wherein the at least one adjustable position arm structure is configured to cooperate with the actuator to adjust a position of the actuator.

23. The exercise unit as defined in claim 22, wherein the actuator comprises a cable.

24. The exercise unit as defined in claim 23, wherein the at least one adjustable position arm structure includes an integral cable guide structure.

25. The exercise unit as defined in claim 23, wherein the at least one adjustable position arm structure includes at least one pulley configured to guide the cable.

26. The exercise unit as defined in claim 21, wherein the at least one adjustable position arm structure comprises two adjustable position arm structures extending outwardly from opposite sides of the frame.

27. The exercise unit as defined in claim 26, wherein:
said two adjustable arms are interconnected by at least one gear.

28. The exercise unit as defined in claim 27, wherein:
said at least one gear is part of a chain drive mechanism.

29. The exercise unit as defined in claim 21, wherein:
said at least one adjustable arm is configured to pivot in a horizontal plane relative to the frame.

30. The exercise unit as defined in claim 17, wherein:
said means for providing a constant load to the user includes a structure configured to compensate for a non-constant force of the resilient bands.

31. The exercise unit as defined in claim 30, wherein:
said structure comprises a spiral pulley.

32. The exercise unit as defined in claim 17, wherein:
at least part of said means for providing a constant load to the user is located beneath said seat.

33. The exercise unit as defined in claim 32, wherein:
said at least part of said means for providing a constant load to the user is configured to compensate for a non-constant force of the resilient bands.

34. The exercise unit as defined in claim 33, wherein:
said at least part of said means for providing a constant load to the user includes a spiral pulley.

35. An exercise unit comprising:
a frame including a member selectively rotatable relative to the frame;
a seat positioned on said frame;
a resistance engine supported by the member and utilizing elastomere springs;
an actuator attached to said resistance engine wherein said resistance engine provides a substantially constant load to a user when said actuator is actuated; and
a load adjustment mechanism continually engaged with the resistance engine and operatively associated with the member, the load adjustment mechanism configured to selectively rotate the member relative to the frame to adjust a magnitude of the substantially constant load provided by the resistance engine.

36. The exercise unit as defined in claim 35, wherein the load adjustment mechanism comprises a crank arm.

37. The exercise unit as defined in claim 35, further comprising at least one adjustable position arm structure attached to the frame.

38. The exercise unit as defined in claim 37, wherein the at least one adjustable position arm structure is configured to cooperate with the actuator to adjust a position of the actuator.

39. The exercise unit as defined in claim 38, wherein the at least one adjustable position arm structure includes an integral cable guide structure.

40. The exercise unit as defined in claim 38, wherein the actuator comprises a cable, and the at least one adjustable position arm structure includes at least one pulley configured to guide the cable.

41. The exercise unit as defined in claim 37, wherein the at least one adjustable position arm structure comprises two adjustable position arm structures extending outwardly from opposite sides of the frame.

42. The exercise unit as defined in claim 41, wherein:
said two adjustable arms are interconnected by at least one gear.

43. The exercise unit as defined in claim 42, wherein:
said at least one gear is part of a chain drive mechanism.

44. The exercise unit as defined in claim 37, wherein:
said at least one adjustable arm is configured to pivot in a horizontal plane relative to the frame.

45. The exercise unit as defined in claim 35, wherein:
said actuator is configured to compensate for a non-constant force of the elastomere springs.

46. The exercise unit as defined in claim 45, wherein:
said actuator includes a spiral pulley configured to compensate for the non-constant force of the elastomere springs.

47. The exercise unit as defined in claim 35, wherein:
said resistance engine and at least part of said actuator are located below said seat.

48. The exercise unit as defined in claim 47, wherein: said frame defines a bench exercise unit.

49. The exercise unit as defined in claim 47, wherein:
said at least part of said actuator is configured to compensate for a non-constant force of the elastomere springs.

50. The exercise unit as defined in claim 49, wherein: said at least part of said actuator includes a spiral pulley.

51. The exercise unit as defined in claim 35, wherein:
said resistance engine and at least part of said actuator are located at least partially beneath said seat.

52. The exercise unit as defined in claim 51, wherein:
said at least part of said actuator is configured to compensate for a non-constant force of the elastomere springs.

53. The exercise unit as defined in claim 52, wherein:
said at least part of the actuator includes a spiral pulley.

54. The exercise unit of claim 35, wherein the actuator comprises a cable.

55. The exercise unit of claim 54, wherein the actuator further comprises a handle coupled to the cable.

* * * * *